US011172710B2

(12) United States Patent
Storelli et al.

(10) Patent No.: US 11,172,710 B2
(45) Date of Patent: Nov. 16, 2021

(54) ADJUSTABLE ATHLETIC BRA

(71) Applicant: STORELLI SPORTS, INC., Brooklyn, NY (US)

(72) Inventors: Claudio Storelli, New York, NY (US); Thomas Vincent Marchesi, New York, NY (US); Sarah Blaser, Brooklyn, NY (US); Hendrik Mark Francis Schermers, Brooklyn, NY (US)

(73) Assignee: STORELLI BRA LLC, Dallas, TX (US)

( * ) Notice: Subject to any disclaimer, the term of this patent is extended or adjusted under 35 U.S.C. 154(b) by 0 days.

(21) Appl. No.: 16/598,256

(22) Filed: Oct. 10, 2019

(65) Prior Publication Data

US 2020/0037673 A1 Feb. 6, 2020

Related U.S. Application Data

(63) Continuation-in-part of application No. PCT/US2018/027332, filed on Apr. 12, 2018, and a continuation of application No. PCT/US2019/020316, filed on Mar. 1, 2019.

(60) Provisional application No. 62/485,233, filed on Apr. 13, 2017, provisional application No. 62/637,063, filed on Mar. 1, 2018, provisional application No. 62/778,206, filed on Dec. 11, 2018.

(51) Int. Cl.

| | |
|---|---|
| ***A41C 3/00*** | (2006.01) |
| ***A41C 3/02*** | (2006.01) |
| ***A41F 1/00*** | (2006.01) |

(52) U.S. Cl.

CPC ..... *A41C 3/0057* (2013.01); *A41C 3/0028* (2013.01); *A41F 1/006* (2013.01); *A41C 3/0014* (2013.01); *A41C 3/02* (2013.01)

(58) Field of Classification Search

CPC ..... A41C 3/0057; A41C 3/0028; A41C 3/02; A41C 3/00; A41C 3/12

USPC ..... 450/86

See application file for complete search history.

(56) References Cited

U.S. PATENT DOCUMENTS

| | | | |
|---|---|---|---|
| 1,400,295 | A | 12/1921 | Kops |
| 1,575,989 | A | 3/1926 | Van A. Haven |
| 2,152,629 | A | 4/1939 | Gluckin |
| 2,337,810 | A | 12/1943 | Glick |
| 2,454,153 | A | 11/1945 | Glick |
| 2,449,808 | A | 9/1948 | Glick |
| 2,553,225 | A | 5/1951 | Weaver et al. |

(Continued)

FOREIGN PATENT DOCUMENTS

| | | |
|---|---|---|
| CN | 203492807 | 3/2014 |
| CN | 203943087 | 11/2014 |

(Continued)

OTHER PUBLICATIONS

International Search Report and Written Opinion, U.S. Patent and Trademark Office, Application No. PCT/US2018/027332, dated Aug. 24, 2018.

(Continued)

*Primary Examiner* — Gloria M Hale

(74) *Attorney, Agent, or Firm* — Gottlieb, Rackman & Reisman, PC

(57) ABSTRACT

An adjustable athletic bra that provides support laterally (side to side), vertically (up and down), and in and out to provide stability in multiple directions.

16 Claims, 32 Drawing Sheets

(56) References Cited

U.S. PATENT DOCUMENTS

| | | | | |
|---|---|---|---|---|
| 2,866,462 | A | 12/1958 | Faron | |
| 3,396,728 | A | 8/1968 | Sachs et al. | |
| 3,478,747 | A | 11/1969 | Sachs | |
| 4,292,975 | A | 10/1981 | Champion et al. | |
| 4,530,361 | A | 7/1985 | Wooten | |
| D281,924 | S | 12/1985 | Martini | |
| 4,911,677 | A | 3/1990 | White | |
| 5,244,432 | A | 9/1993 | Moy Au et al. | |
| 5,823,851 | A | 10/1998 | Dicker | |
| 5,863,236 | A * | 1/1999 | Johnson | A41C 3/0057 450/60 |
| 5,868,601 | A | 2/1999 | Kelemencky | |
| 6,068,538 | A | 5/2000 | Alleyne | |
| D475,506 | S | 6/2003 | Hoffman et al. | |
| 7,448,937 | B2 | 11/2008 | Weyenberg et al. | |
| 7,591,706 | B2 | 9/2009 | Barbour et al. | |
| 8,523,629 | B2 | 9/2013 | Pundyk | |
| D708,821 | S | 7/2014 | Iamartino | |
| D733,395 | S | 7/2015 | Valencia | |
| 9,241,514 | B2 | 1/2016 | Shearer | |
| 9,265,288 | B2 | 2/2016 | Mazourik et al. | |
| D750,868 | S | 3/2016 | Randall | |
| D764,746 | S | 8/2016 | Randall | |
| 9,480,287 | B2 | 11/2016 | Black et al. | |
| 9,480,288 | B2 | 11/2016 | Shashy | |
| 9,578,901 | B2 | 2/2017 | Randall et al. | |
| D785,903 | S | 5/2017 | Chaleangsak | |
| D786,530 | S | 5/2017 | Lee et al. | |
| D798,536 | S | 10/2017 | Holmes | |
| D808,114 | S | 1/2018 | Begriche et al. | |
| 2008/0064299 | A1 | 3/2008 | La Fontaine | |
| 2009/0233522 | A1 | 9/2009 | Schlatmann | |
| 2010/0279584 | A1 | 11/2010 | Gordon | |
| 2011/0081827 | A1 | 4/2011 | Williams | |
| 2011/0117818 | A1* | 5/2011 | Barnard | A41C 3/0057 450/58 |
| 2011/0177757 | A1* | 7/2011 | Swendseid | A41C 3/0028 450/70 |
| 2012/0021669 | A1 | 1/2012 | Johnstone | |
| 2012/0208433 | A1 | 8/2012 | Solotoff | |
| 2013/0203319 | A1 | 8/2013 | Torres et al. | |
| 2014/0087625 | A1 | 3/2014 | Ironi | |
| 2014/0259301 | A1 | 9/2014 | Berns et al. | |
| 2016/0081398 | A1* | 3/2016 | Tempesta | A41C 3/0028 450/70 |
| 2017/0273365 | A1 | 9/2017 | Muhlenfeld | |

FOREIGN PATENT DOCUMENTS

| | | |
|---|---|---|
| CN | 204907974 U | 12/2015 |
| DE | 202011000133 | 4/2011 |
| EP | 3 262 960 | 1/2018 |
| FR | 1462298 | 4/1966 |
| GB | 214047 | 4/1924 |
| GB | 1527194 | 10/1978 |
| JP | 11-200107 | 7/1999 |
| JP | D1110587 | 6/2001 |
| KR | 3007681890000 | 7/2014 |
| KR | 3007980210000 | 5/2015 |
| WO | 2008/017707 | 2/2008 |

OTHER PUBLICATIONS

OMsignal's smart sports bra gives wearers instant workout feedback, http://http://waaaat_welovead.com/cn/top//detail/6b7wjmwzg.html, Feb. 16, 2018.

Extended Search Report, European Patent Office, EP Application No. 18783993.1, dated Nov. 27, 2020.

Office Action, Chinese National Intellectual Property Administration, Application No. 2018800368293, dated Mar. 11, 2021.

* cited by examiner

ADJUSTABLE ATHLETIC BRA

CROSS-REFERENCE TO RELATED APPLICATIONS

This patent application is a continuation-in-part of PCT/US2018/027332, filed Apr. 12, 2018, which claims benefit to U.S. Provisional Patent Application No. 62/485,233, filed Apr. 17, 2017, and U.S. Provisional Patent Application No. 62/637,063, filed Mar. 1, 2018, which are hereby incorporated by reference in their entirety as part of the present disclosure.

This patent application is a continuation of PCT/US2019/020316, filed Mar. 1, 2019, which claims benefit to U.S. Provisional Patent Application No. 62/637,063, filed Mar. 1, 2018, and U.S. Provisional Patent Application No. 62/778,206, filed Dec. 11, 2018, which are hereby incorporated by reference in their entirety as part of the present disclosure.

FIELD OF THE INVENTION

The present invention relates generally to a support garment, and more specifically to a bra that has support features that simultaneously provides stability, support and comfort.

BACKGROUND OF THE INVENTION

Various support garment designs, which include bras, are known. Many bras are designed to primarily limit vertical movement of breasts. Such movement commonly occurs due to repetitive motion (e.g., walking, running) in a single direction that cause breasts to move up and down (vertically). However, during an athletic activity, breasts commonly move in eight different directions including upward movement, downward movement, side to side movement (i.e., movement of breasts left and right) and movement inward and outward. Movement of breasts in these eight directions occurs especially during explosive movements (e.g., shuffling quickly from side to side while playing, soccer, basketball or tennis) where such movement causes an abrupt shifts in weight that can in turn cause the breasts to move uncomfortably if not properly stabilized.

Current athletic bra designs are commonly secured either at the front or rear using a hook and eye closure system or a similar system and can include strap adjustment features. However, such conventional bra designs do not provide adequate three-dimensional support to prevent substantial movement of breasts up and down, side to side and in and out during exercise or an athletic activity and can be difficult to adjust. Additionally, these bras commonly include molded cups that typically do allow for a proper fit as breast shapes and sizes range widely. Alternatively, athletic bra designs can be pre-sized seamed or seamless bras that can be pulled over an individual's head and include openings through which the individual can extend their arms. These bras designs regularly include elastomeric features. However, conventional pre-sized pullover bra designs do not provide adequate three-dimensional support to prevent substantial movement of breasts up and down, side to side and in and out during exercise or an athletic activity and are not adjustable to ensure proper fit and support. Additionally, the compression of breasts using these bras is commonly uncomfortable.

SUMMARY OF THE INVENTION

The present invention is directed to an adjustable athletic bra that minimizes three-dimensional movement of breasts laterally (side to side), vertically (up and down), and in and out (i.e., eight dimensional movements of breasts) to provide stability of breasts in multiple directions and allows for customization of the fit of the bra as desired. The bra can be customized dynamically based on the activity and preference of an individual wearing the bra and supports breasts independently to address any asymmetry. The bra provides both full support and comfort.

In an embodiment, the present invention is directed to a bra that comprises a body includes a front portion, a rear portion, a first side portion that extends between a first end of the front portion and a first end of the back portion, a second side portion that extends between a second end of the front portion and a second end of the rear portion, a first shoulder strap that is fixed to and extends between the front portion and the rear portion and a second shoulder strap that is fixed to and extends between the front portion and the rear portion. The back portion includes a first back strap system and a second back strap system that are independent of each other and a front support system that is affixable to the front portion and that includes a first piece of material and a second piece of material and that is configured to adjust tension across the front portion of the bra.

The first shoulder strap can be comprised of two pieces of material that are connected to each other with one piece of material including elastomeric properties and the other piece of material including non-elastomeric properties and the second shoulder strap can be comprised of two pieces of material that are connected to each other with one piece of material including elastomeric properties and the other piece of material including non-elastomeric properties.

The first back strap system can include a first leg, a second leg that extends at a first angle in a first direction from the first leg toward the second side portion and a third leg extending at a second angle from the first leg in a second direction toward the first side portion and a first panel that extends contiguously from the third leg. The second back strap system, which is independent of the first back strap system and a mirror opposite configuration of the first back strap system can include a first leg, a second leg that extends at a first angle in a first direction from the first leg toward the first side portion and a third leg that extends at a second angle from the first leg in a second direction toward the second side portion and a second panel that extends contiguously from the third leg. The first panel can extend from the back portion around the first side portion toward the front portion and is fixed along a bottom edge thereof to the band. The second panel can extend from the back portion around the second side portion toward the front portion and can be fixed along a bottom edge thereof to the band.

The bra can include a band that extends about a periphery thereof at the bottom end of the front portion, the rear portion and the first side portion and second side portion. The band can be comprised of an elastomeric material to allow for adaptability and to aid in compression of the bra. The band can include a fastening system to fix to a first end and a second end thereof to each other.

The front portion of the bra can comprise a plurality of layers of material including an external support layer and a cup layer. The support layer can include at least one panel whereby at least a portion of the panel includes elastomeric properties. The cup layer can include a first cup and a second cup, which is independent of the first cup. The first piece of material and the second piece of material can each be comprised of a single piece of elastomeric material. Alternatively, the first piece of material and the second piece of material can each be comprised of a blend of non-elastomeric and elastomeric material. The first piece of material and the second piece of material can be independent elements of each other such that one of the first piece of material and the second piece of material slides over or under the other of the first piece of material and the second piece of material. The first piece of material can be fixed to the first shoulder strap and a first end of the second piece of material is fixed to the second shoulder strap.

In another embodiment, the present invention is directed to a method of securing an athletic bra that includes the steps of placing the bra on an individual, connecting a first end of the band to a second end of the band, grasping and pulling the first side strap such that the second shoulder strap is tensioned, the second piece of material that is part of the front support system compresses at least a respective first half of the front portion toward the user and the first back strap system is tensioned toward the first side portion, connecting the first side strap to the band at the front portion, grasping and pulling the second side strap such that the first shoulder strap is tensioned, the first piece of material that is part of the front support system compresses at least a respective second half of the front portion toward the individual and the second back strap system is tensioned toward the second side portion and connecting the second side strap to the band at the front portion.

In an embodiment, a bra includes a front portion, a rear portion, and a band. The front portion may include a compression layer. The band may be connected to a bottom region of the front portion and may extend along at least a portion of the bottom region of the front portion. The rear portion may include a first back strap system and a second back strap system configured to have a mirror arrangement with respect to the first back strap system.

The first back strap system may include a first leg, a second leg, and a third leg interconnected to one another at a first juncture. The first leg may extend from the first juncture in a first direction, and may be connected to a top region of the front portion at a first side of the front portion.

The second leg may extend from the first juncture in a second direction different from the first direction, the second leg may be connected to the bottom region of the front portion at the first side of the front portion.

The third leg may extend from the first juncture in a third direction different from the first and second directions, the third leg may be configured to be selectively and adjustably connected to the band at the first side of the front portion in order to cause a selectable degree of tension in the first and second legs such that the first and second legs, in turn, compress a wearer's torso as a result of the tension in the first and second legs.

The second back strap system may include a fourth leg, a fifth leg, and a sixth leg interconnected to one another at a second juncture. The fourth leg may extend from the second juncture in a fourth direction, and may be connected to the top region of the front portion at a second side of the front portion.

The fifth leg may extend from the second juncture in a fifth direction different from the fourth direction, the fifth leg may be connected to the bottom region of the front portion at the second side of the front portion.

The sixth leg may extend from the second juncture in a sixth direction different from the fourth and fifth directions, the sixth leg being configured to be selectively and adjustably connected to the band at the second side of the front portion in order to cause a selectable degree of tension in the fourth and fifth legs such that the fourth and fifth legs, in turn, compress the wearer's torso as a result of the tension in the fourth and fifth legs.

In addition, the bra may include a support system, the support system including a first tensioning element and a second tensioning element. The first tensioning element may connect the top region of the front portion, at the first side of the front portion, with either the band or the compression layer. The second tensioning element may connect the top region of the front portion, at the second side of the front portion, with either the band or the compression layer.

The combination of the front and rear portions of the bra, together with the support system, may provide a comfortable and supporting fit, enabling the bra to, for example, stabilize the cups of the front portion in position, and provide tension across the top and bottom of the breasts. Thus, the bra may prevent or substantially reduce upward and downward motion, left to right motion, and inward out outward motion of the wearer's breasts during motion and/or a state of rest.

DETAILED DESCRIPTION OF EMBODIMENTS OF THE INVENTION

Figure 1:
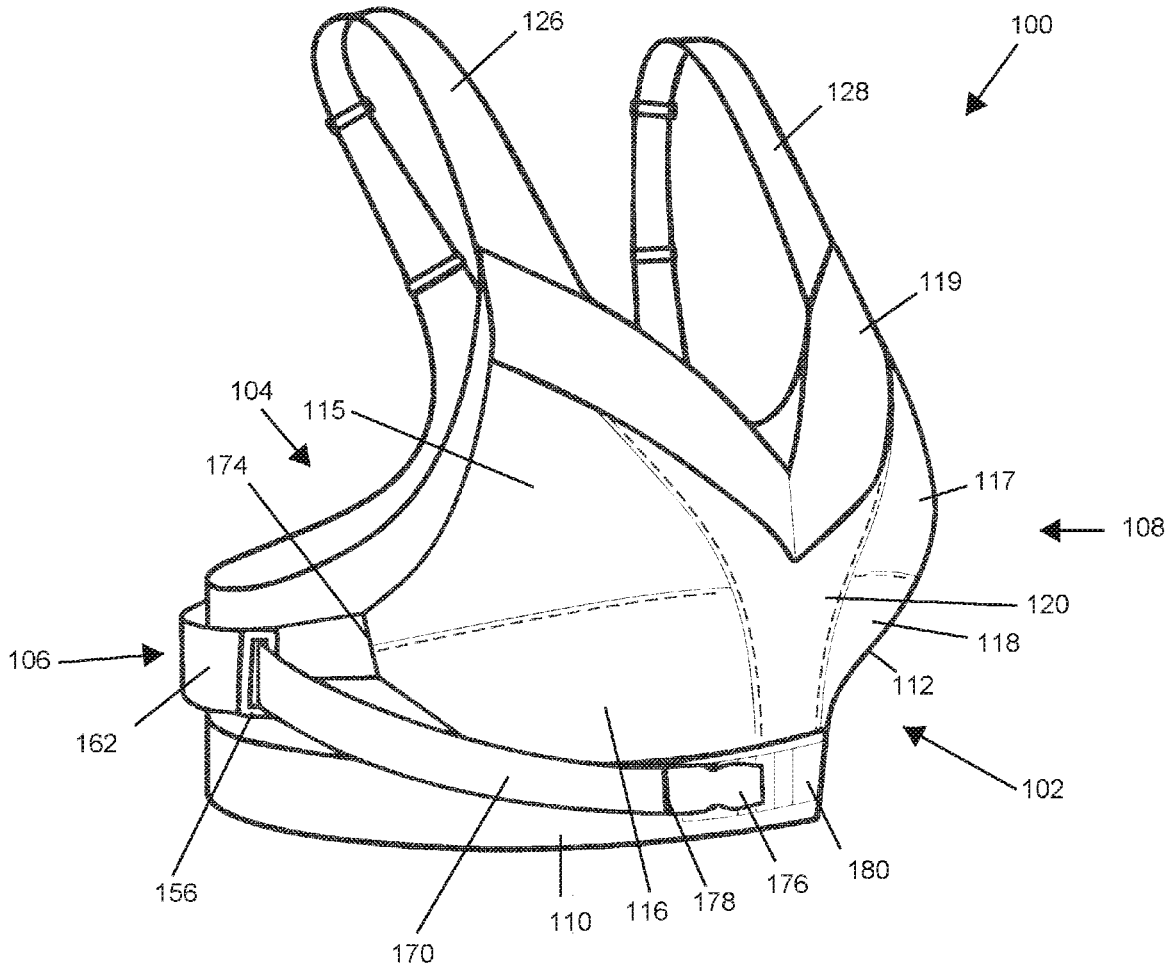
FIG. 1 is a front perspective view of an embodiment of an adjustable athletic bra of the present invention.
Figure 2:
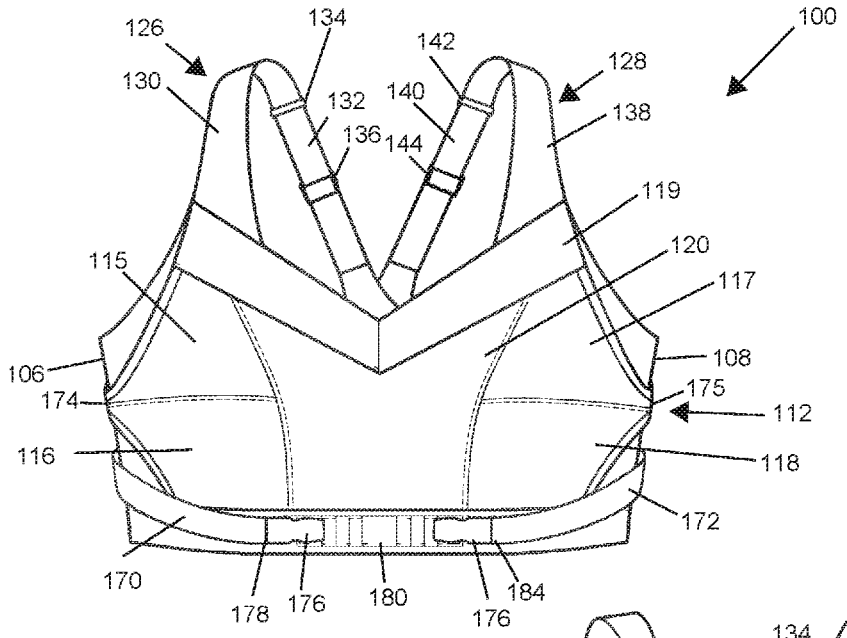
FIG. 2 is a front view the bra of FIG. 1.

With reference now to the drawings and in particular FIGS. 1-44, embodiments of athletic bras of the present disclosure, which are generally designated by the reference numerals 100, 200 and 300, 400 will be described.

As will be discussed in more detail below, the bra 100, 200, 300, 400 includes interconnected elements that in use together evenly compress and support breasts to ensure lateral (left and right), vertical (up and down) and in and out stabilization of the breasts. By providing support and compression across these directions, the bra 100, 200, 300, 400 minimizes three-dimensional movement of breasts across at least eight directions of travel.

As shown in FIGS. 1-3B, the athletic bra 100 includes a front portion 102, a rear portion 104, a first side, or left side, portion 106 that extends between a first end of the front portion 102 and a first end of the rear portion 104 and a second side, or right side, portion 108 that extends between a second end of the front portion 102 and a second end of the rear portion 104. A base 109 (see FIG. 6) extends about a lower region of the front portion 102, the rear portion 104 and the side portions 106, 108. A band 110 extends about the periphery of the bra 100 at the bottom end of the front portion 102, rear portion 104 and side portions 106, 108. The band 110 can be comprised of an elastomeric material to allow for adaptability and to aid in compression of the bra 100 to various individual's bodies. The band 110 includes a fastening system 113 (see FIGS. 3A and 3B) fixed to a first end and a second end thereof. The fastening system 113 includes a hook and eye configured to receive the clasp or hook. However, the fastening system 113 should not be limited to that shown. Exemplary fasteners that can comprise the fastening system 113 can include snaps, clips, buttons, hook and loop fasteners, ties, etc.

The front portion 102, as can be seen, for example, by viewing FIGS. 1-4, can comprise a plurality of layers of material including an external support layer 112 and a cup layer 114. The support layer 112 can be divided into a plurality of panels, including a first front panel 115, a second front panel 116, a third front panel 117, a fourth front panel 118, a fifth front panel 119 and a sixth panel 120. The fifth front panel 119 is arranged above the first, second, third, fourth and sixth panels 115, 116, 117, 118, 120. The sixth front panel 120 is arranged between the first and second front panels 115, 116 and the third and fourth front panels 117, 118. The panels 115, 116, 117, 118, 119, 120 can each be comprised, for example, of woven fabric, nonwoven fabric, synthetic fabric, fabric that includes moisture wicking capabilities, webbing and/or fabric that, at least in part, is elastomeric. Additionally, the panels 115, 116, 117, 118, 119, 120 can be coated to increase and/or decrease the modulus of elasticity of one or more of the panels 115, 116, 117, 118, 119, 120. The panels 115, 116, 117, 118, 119, 120 can be connected to each other by, for example, sewing or bonding the panels 115, 116, 117, 118, 119, 120 to each other. The entirety of the support layer 112 can be a single piece of material that is compression molded to form a three-dimensional shape. In an embodiment, at least a portion of a third panel 120 can include elastomeric properties to aid in compressing and stabilizing the breasts of an individual wearing the bra 100. The cup layer 114 includes a first cup 122 and a second cup 124, which is independent of the first cup 122. Alternatively, the cups 122, 124 can be molded from a single piece of material (e.g., foam) and thus connected to each other. The cups 122, 124 can, for example, be sewn, molded or bonded to the external support layer 116 and/or the base 109 and directly contactable with the breasts of an individual upon securing the bra 100 to the individual. In the embodiment where the cups 122, 124 are joined to the base 109, the components would be a single unit. In an embodiment, one or more layers (e.g., cup layer 114) can be eliminated or interchanged. Additionally, the layers can be independent of each other.

A first shoulder strap 126 and a second shoulder strap 128 that is spaced from the first shoulder strap 126 each extend between the front portion 102 and the rear portion 104 of the bra 100. The straps 126, 128 can, at least in part, be comprised of a material or blend of materials that include elastomeric properties.

Figure 6:
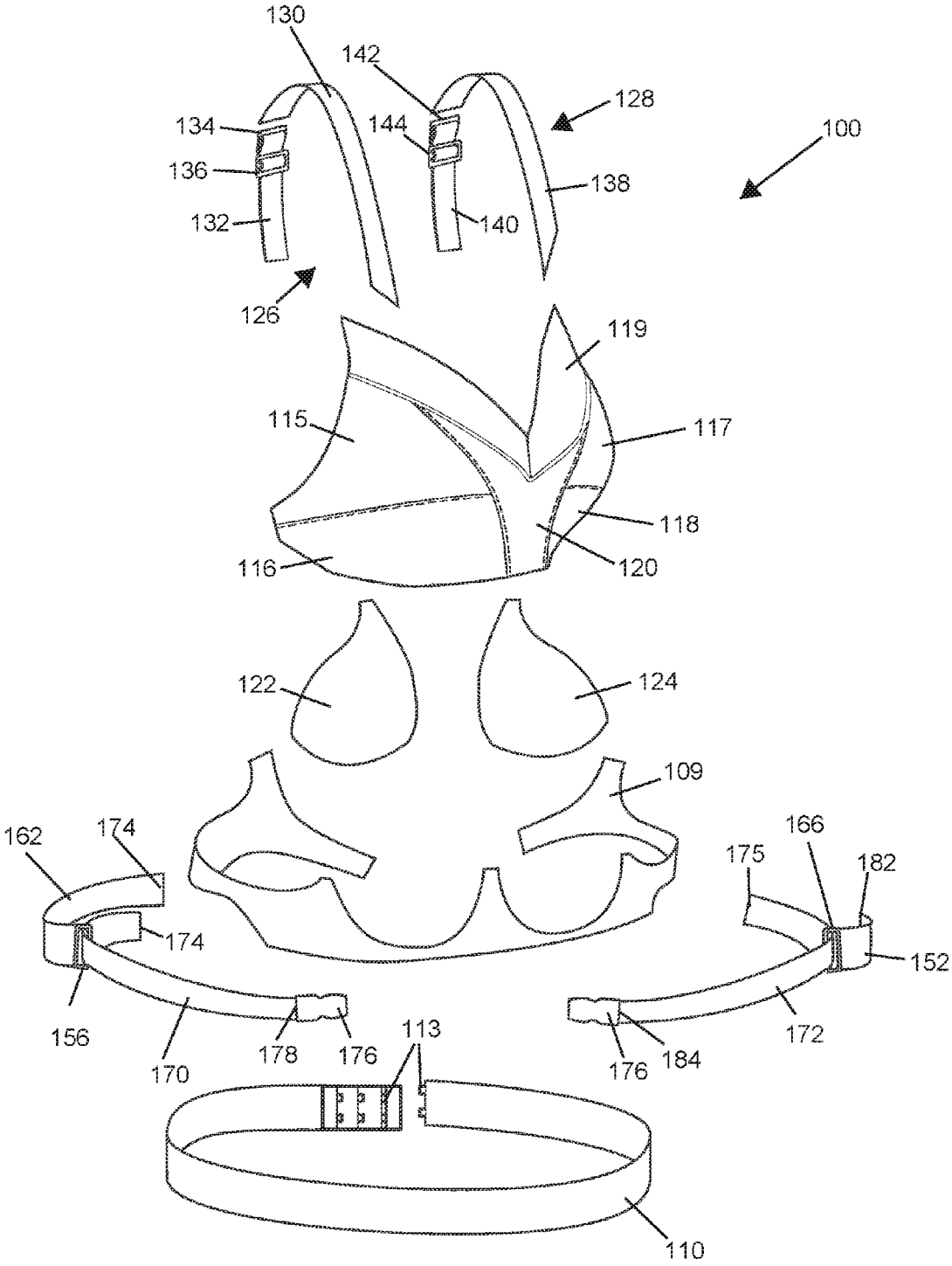
FIG. 6 is an exploded view of various features of the bra of FIG. 1.
Figure 7A:
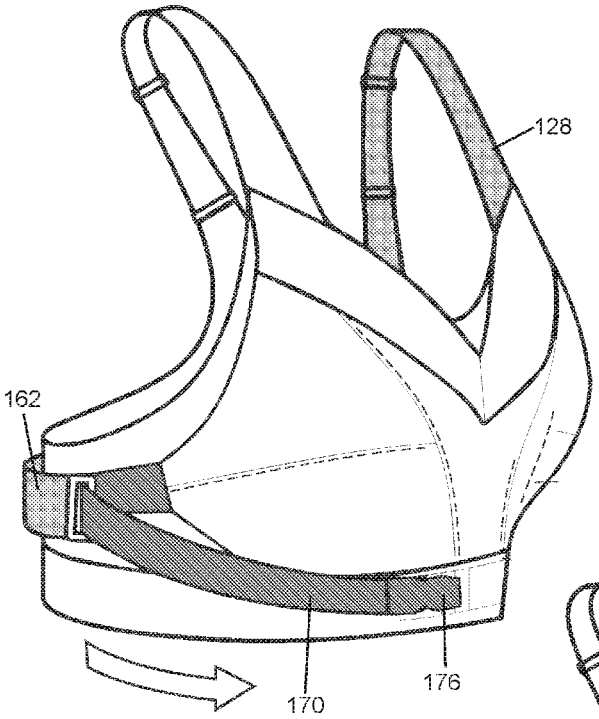
FIGS. 7A-7D are views of the bra of FIG. 1 depicting how features of the bra act in concert to stabilize laterally, vertically and in and out.
Figure 7B:
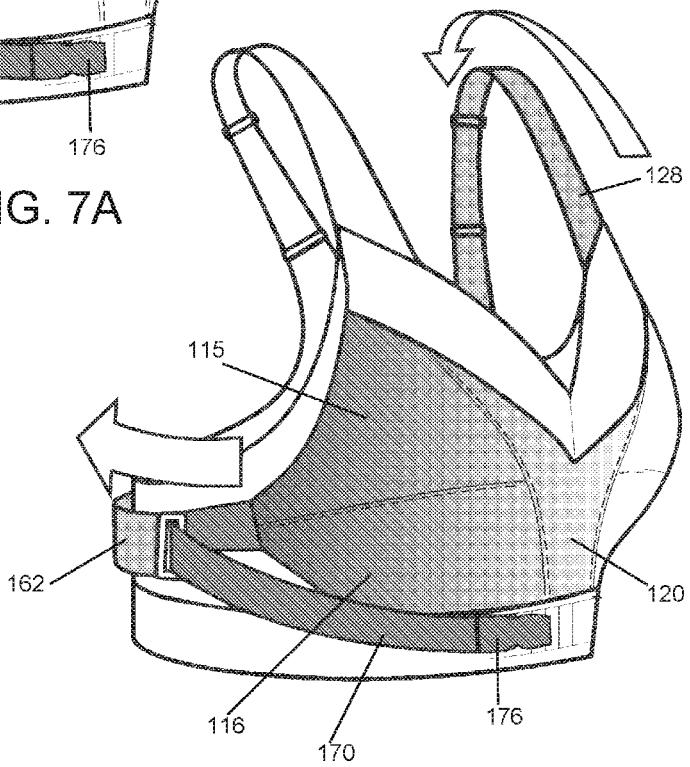
Figure 7C:
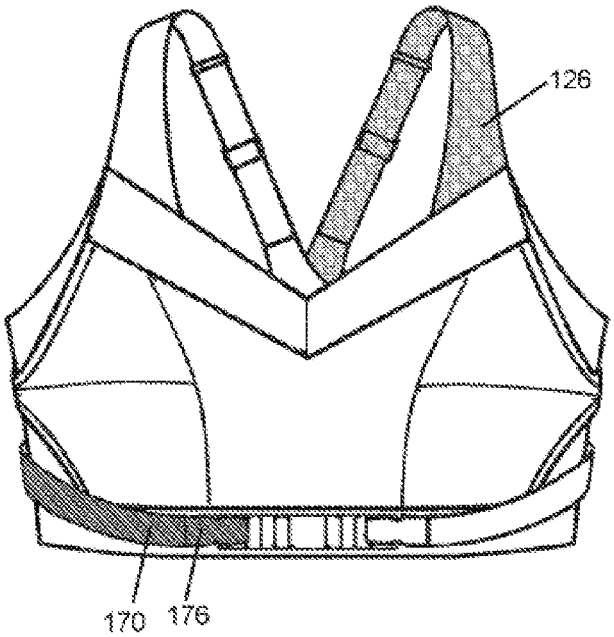
Figure 7D:
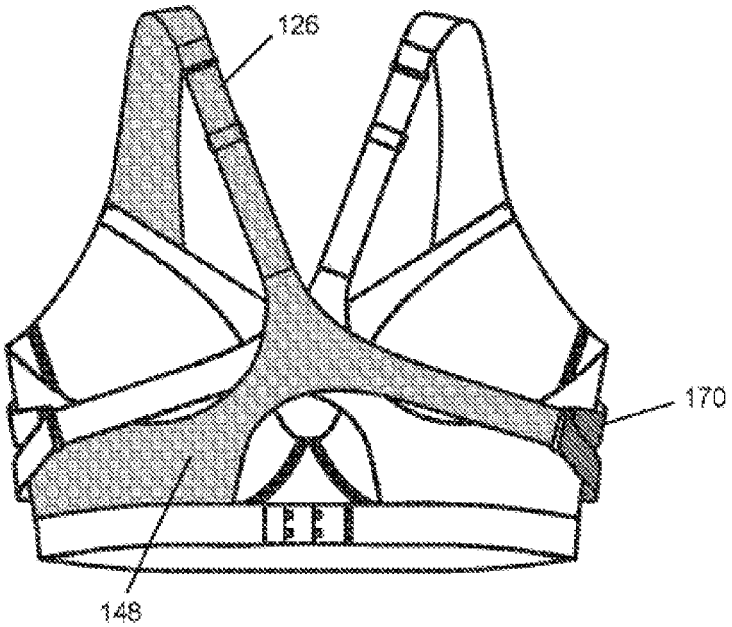

As shown in FIG. 6, the first shoulder strap 126 includes a first piece of material, or blend of materials, 130 that is not at least substantially comprised of an elastomer to aid in the tensioning of the bra 100 and a second piece of material, or blend of materials, 132 that is comprised at least in part of an elastomer to aid in adjusting the strap 126. The second piece of material 132 is fixed to the first piece of material 130 by a first connection mechanism 134, such as a first loop, and an adjustment mechanism 136, such as a slide, can be arranged on the second piece of material 132 to aid in adjusting the length of the first shoulder strap 126 to ensure a proper, supportive and comfortable fit. Alternatively, the configuration can be reversed such that the second piece of material (elastomeric) 132 is attached to the front panel 102 and the first piece of material (non-stretch) 130 is affixed to a second end of the second piece of material 132 to the back portion 104. In another embodiment the first piece of material 130 can taper in width and attach directly to the first connection mechanism 134 or the second piece of material 132 with the first connection mechanism 134 located at the second end of the second piece of material 132 or webbing can be attached at the second end of the second piece of material 132. In another configuration, the first connection mechanism 134 and the adjustment mechanism 136 can be combined into a single element. In another configuration, a single piece of material can be used to form the first shoulder strap 126.

Like the first shoulder strap 126, the second shoulder strap 128 includes a first piece of material (or blend of materials) 138 that is not at least substantially comprised of an elastomer to aid in the tensioning of the bra 100 and a second piece of material (or blend of materials) 140 that is comprised at least in part of an elastomer to aid in adjusting the strap 128. The second piece of material 140 is fixed to the first piece of material 138 by a second connection mechanism 142, such as a first loop, and an adjustment mechanism 144, such as a slide, can be arranged on the second piece of material 140 to aid in adjusting the length of the second shoulder strap 128 to ensure a proper, supportive and comfortable fit. Alternatively, the configuration can be reversed such that the second piece of material 140 is attached to the front panel 102 and the first piece of material (non-stretch) 138 is affixed to a second end of the second piece of material 140 to the back portion 104. In another embodiment the first piece of material 138 can taper in width and attach directly to the second connection mechanism 142 or the second piece of material 140 with the second connection mechanism 142 located at the second end of the second piece of material 140 or webbing can be attached at the second end of the second piece of material 140. In another configuration, the second connection mechanism 142 and the adjustment mechanism 144 can be combined into a single element. In yet another configuration, a single piece of material can be used to form the second shoulder strap 128.

In an embodiment adjustment mechanisms 136, 144 may be eliminated and adjustment of the straps 126, 128 can be made, for example, by a hook and loop fastening system, hooks, sliders, webbing, buttons, snaps, etc. Although the shoulder straps 126, 128 are independent of each other as shown herein, the straps 126, 128 can cross at the back portion 104 of the bra 100 or merge (e.g., racerback).

Figure 3A:
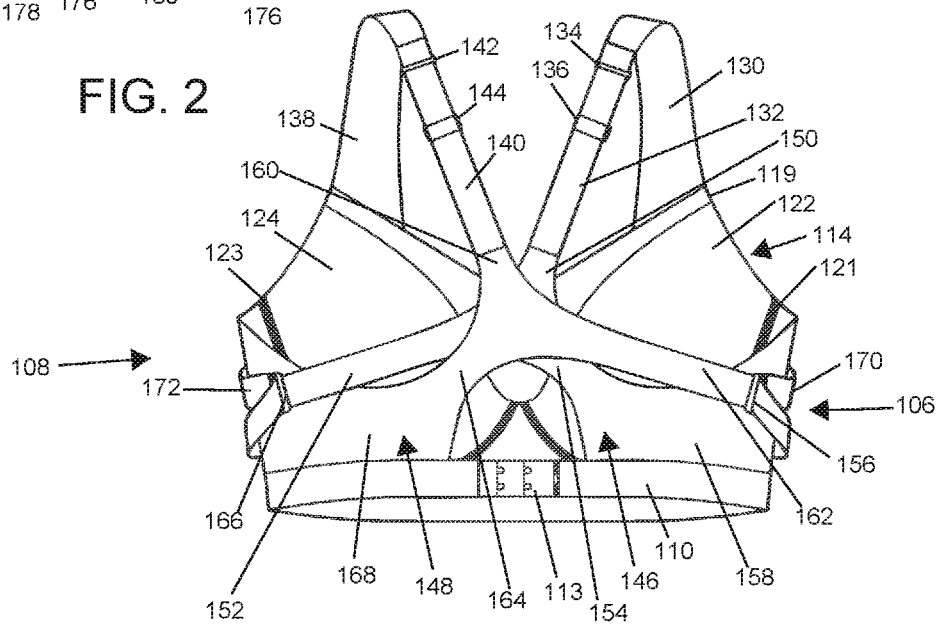
FIG. 3A is a rear view the bra of FIG. 1 that includes an adjustable system to ensure proper support with the adjustable system in a closed position.
Figure 3B:
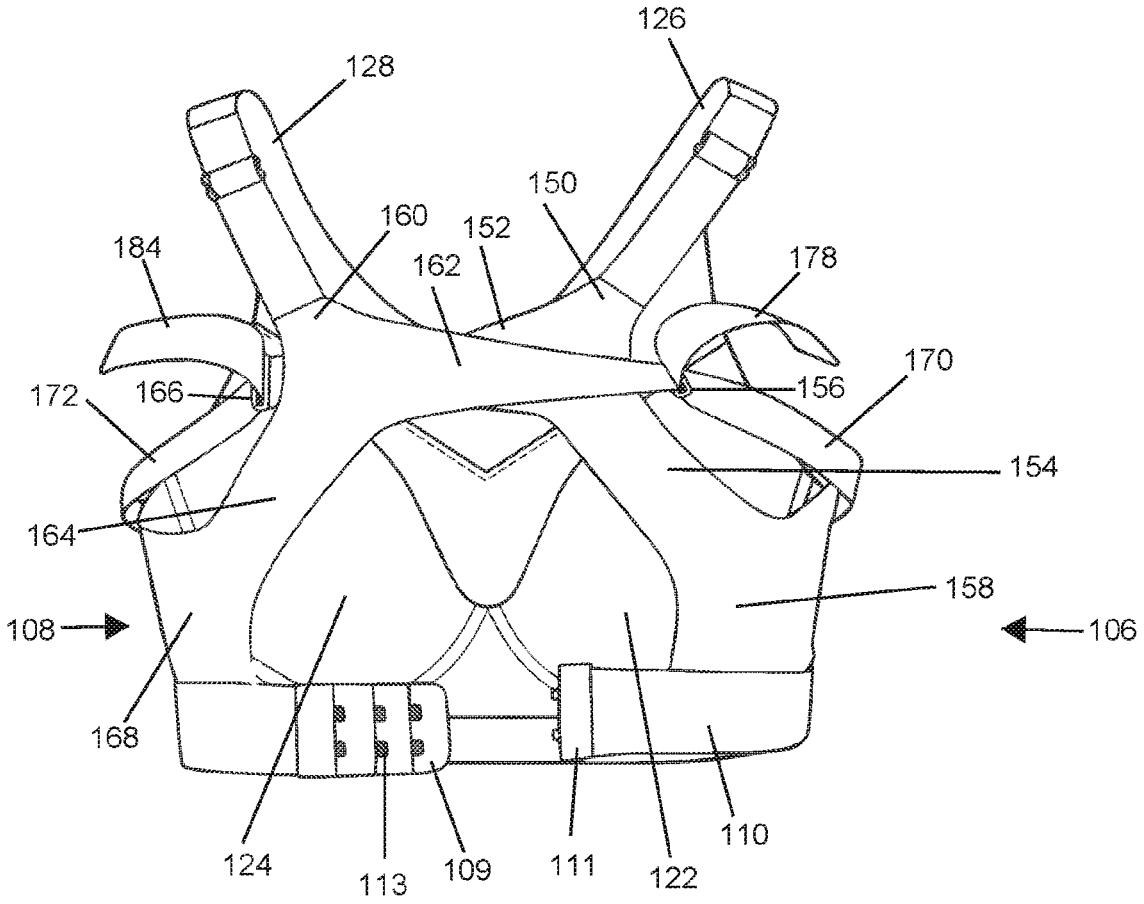
FIG. 3B is a rear view the bra of FIG. 1 showing the adjustable system in an open position.
Figure 4:
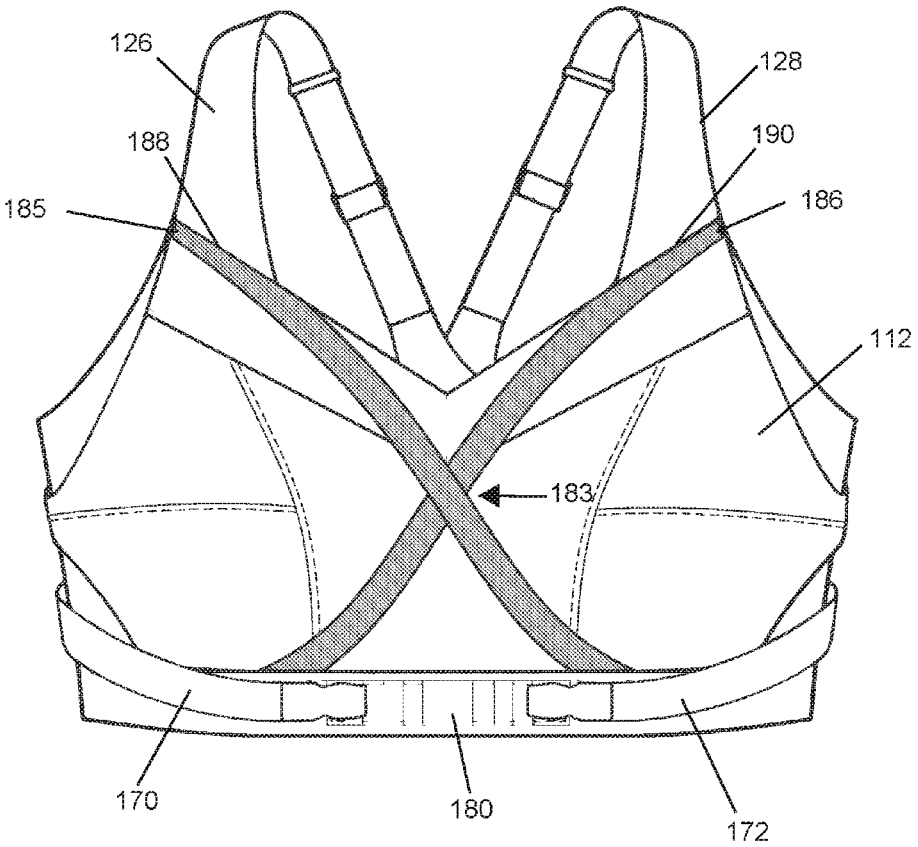
FIG. 4 is a front view of the bra of FIG. 1 depicting support features in accordance with an aspect of the present invention.

As depicted, for example, in FIGS. 3A-4, the back portion 104 of the bra 100 includes a first back strap system 146 and a second back strap system 148. The first back strap system 146 includes a first leg 150 that is connected to the second end of the first shoulder strap 126, a second leg 152 that extends at a first angle in a first direction from the first leg 150 toward the second side portion 108 and a third leg 154 that extends at a second angle from the first leg 150 in a second direction toward the first side portion 106. The second leg 152 is fixed at a distal end thereof to a slide 166. The third leg 154 extends contiguously at a second end thereof to a first panel 158. The first panel 158, which is part of the base 109, extends from the back portion 104 around the first side portion 106 toward the front portion 102. The first panel 158 is fixed along a bottom edge thereof to the band 110 and to a sidewall 121 of the first cup 122. Alternatively, the first panel 158 and the first cup 122 can be a single-piece construction, eliminating the sidewall 121 connection. The second back strap system 148 is independent of the first back strap system 146 and a mirror opposite configuration of the first back strap system 146. The second back strap system 148 includes a first leg 160 that is connected to the second end of the second shoulder strap 128, a second leg 162 that extends at a first angle in a first direction from the first leg 160 toward the first side portion 106 and a third leg 164 that extends at a second angle from the first leg 160 in a second direction toward the second side portion 108. The second leg 162 is fixed at a distal end thereof to a slide 156. The third leg 164 extends contiguously at a second end thereof to a second panel 168. The second panel 168 extends from the back portion 104 around the second side portion 108 toward the front portion 102. As can be seen in FIGS. 3A-4, the second panel 168 is fixed along a bottom edge thereof to the band 110 and to a sidewall 123 of the second cup 124. Alternatively, the second panel 168 and the second cup 124 can be a single-piece construction, eliminating the sidewall 123 connection.

The back straps systems 146, 148 can be made of any material that includes, but is not limited to woven fabric, non-woven fabric, synthetic fabric, fabric that includes moisture wicking capabilities and/or fabric that, at least in part, is elastomeric.

A first side strap 170 and a second side strap 172 are configured to aid in compressing the bra 100. The first side strap 170, which extends through the slide 156, is fixed at a first end 174 to the first and second front panels 115, 116 and includes a fastener 176 fixed to a second end 178 thereof to aid in securing the first side strap 170 to an adjustment panel 180 that is centrally fixed about the front panel to the band 110. The second side strap 172, which extends through the slide 166, is fixed at a first end 175 to the third and fourth front panels 117, 118 and includes the fastener 176 fixed to a second end 184 thereof to aid in securing the second side strap 172 to an adjustment panel 180. As shown, the fastener 176 is a hook that is arranged within an opening in the adjustment panel 180. However, the fastener can be a clip, a snap, a button, a hook and loop fastener, among others. As shown, the panel 180 includes opening in which the fasteners 176 can be received. However, it is noted that the connection can be made using buttons, a hook and eye fastening system, snaps, sliders, hooks, ties or any other means that allows for s secure connection. It is noted that although the side straps 170, 172 are shown as being connected to the center panel 180, the straps 170, 172 can in another embodiment be connected to each other, connected directly to the front panel or connected to another feature of the bra 100.

Figure 5:
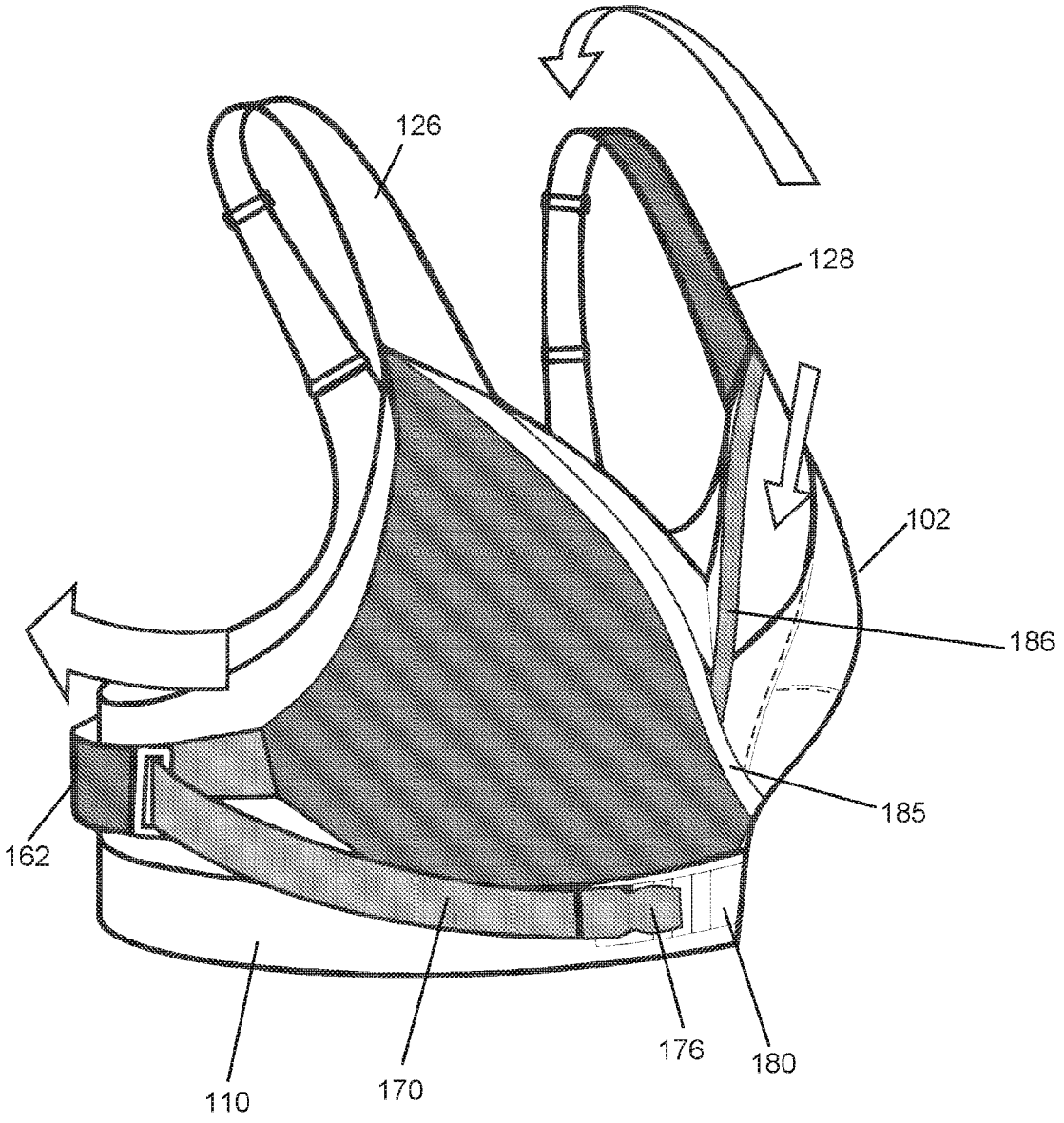
FIG. 5 is front perspective view of the bra of FIG. 1 showing the support feature of FIG. 4 and the synergistic movement of feature of the bra when tightened.

As shown in FIGS. 4 and 5, the bra 100 can include a front support system 183 is comprised of a first piece of material 185 and a second piece of material 186 that is configured to adjust tension across the front portion 102 of the bra 100. In an embodiment, the front support system 183 can be comprised of multiple separate pieces of material that are joined form the first and second piece of material 185, 186. In an embodiment, the first piece of material 185 and the second piece of material 186 are each comprised of a single piece of elastomeric material. Alternatively, the first piece of material 185 and the second piece of material 186 can be comprised of a blend of non-elastomeric and elastomeric material. In such an embodiment, the approximately a portion of each of the first and second pieces of material 185, 186 can be comprised of elastomeric material and the other portion can be comprised of non-stretch material. In such a system 183, the elastomeric material can encompass the upper or lower portion of each piece of material 185, 186 to aid in compressing the upper portion of the bra 100 and the upper or lower portion of each piece of material 185, 186 can be comprised of non-stretch material to aid in keeping the breasts contained within the 122, 124 cups. The first piece of material 185 and the second piece of material 186 can be independent of each other such that one sides over or under the other. Alternatively, the first piece of material 185 and the second piece of material 186 can be independent of each other and connectable directly to each other (e.g., hook and loop system) or the first piece of material 185 and the second piece of material 186 can be fixed to each other. As shown in FIGS. 4 and 5, a first end 188 of the first piece of material 185 can be directly or indirectly fixed to the first shoulder strap 126 and a first end 190 of the second piece of material 186 can be directly or indirectly fixed to the second shoulder strap 128. The front support system 183 can be integrated into a layer of material of the bra 100. The front support system 183 can be adjusted for example, by tensioning the shoulder straps 126, 128 or an adjustment mechanism (not shown) can be included to adjust the length of the first and/or second pieces of material 185, 186. Exemplary adjustment mechanism can include elastics, textiles, webbing, seamless knitting (single integrated piece of material), three-dimensionally printed material, etc. and such components can be comprised of elastomeric material, non-elastomeric material or combination thereof. Adjustment components can be nested or can extend through layers of the bra 100 (e.g., straps of back panels can extend through holes in fabric that hide mechanism) or rest completely exterior the bra 100 or inside the bra 100. Although the front support system 183 is shown as forming an "X" shape, the configuration of components of the front support system 183 should not be limited to such a shape.

Prior to wearing the athletic bra, an initial, one-time setup is required to adjust the bra 100 to fit properly. First, the first side strap 170 and the second side strap 172 are loosened completely to allow the first back strap system 146 and the second back strap system 148 to be spaced apart from each other and create an opening at the rear of the bra 100. The bra 100 is then slipped over an individual's head. Next, the first end of the band 110 is releasably connected to the second end of the band 110. As noted above, there are a plurality of settings that can be selected to ensure a snug, but comfortable fit. Once the band 110 is secured, the first side strap 170 and the second side strap 172 are pulled from the rear portion 104 across the first side 106 of the bra 100 and the second side 108 of the bra 100, respectively, until the straps 170, 172 are each snug. The straps 170, 172 are then each releasably fixed to the band 110 at the front portion 102 of the bra 100. The tension of the first shoulder strap 126 and the second shoulder strap 128 are then checked. There should be no slack and the tension of each strap 126, 128 should be snug, but not uncomfortably tight. If the shoulder straps 126, 128 are too tight to allow the first side strap 170 and the second side strap 172 to be releasably fixed easily and comfortably, the bra 100 should be removed and the shoulder straps 126, 128 should be adjusted/loosened to increase the length of the straps 126, 128. If there is too much slack to allow the first side strap 170 and the second side strap 172 to be releasably fixed to the band 110 at the front portion 102 of the bra 100, the first side strap 170 and the second side strap 172 are too loose. The bra 100 should be removed and the shoulder straps 126, 128 should be adjusted/tightened as needed to shorten the length of the straps 126, 128. Once the initial set-up is complete, the bra 100 can be worn without the need to make adjustments for each use.

As shown generally in FIGS. 7A-7D, once the bra 100 has been initially adjusted, to wear the bra 100, an individual first places the bra 100 over their head and extends their arms in openings created by the shoulder straps 126, 128 and side portions 106, 108. The individual then connects the first end 107 of the band 110 is connected to the second end 111 of the band 110 via the fastening system 113. Next, the first side strap 170 and the second side strap 172 are grasped and pulled toward the adjustment panel 180 at the front portion 102 of the bra 100 and the side straps 170, 172 are connected via the fastener 176 at a desired position thereto.

As the first side strap 170 is being pulled toward the adjustment panel 180, the first end 174 of the first side strap 170 pulls the second back strap system 148 with in turn the first and second front panels 115, 116 outwardly toward the first side portion 106 and inwardly toward the individual's chest (e.g., toward the back portion 104) along with at least a portion of the front support system 183. Similarly, when the second side strap 172 is being pulled toward the adjustment panel 180, the first end 175 of the second side strap 172 pulls the first back strap system 146 with in turn the third and fourth front panels 117, 118 outwardly toward the second side portion 108 and inwardly toward the individual's chest (e.g., toward the back portion 104) along with at least a portion of the front support system 183.

The connection of the side straps 170, 172 and the legs 148, 152 of the back straps 148, 150/side portions 106, 108 results in the front panels 115-120 uniformly pulled in all three axes of movement, ensuring that the center of gravity of the breasts are unmoved from their natural position, but rather compressed evenly to an individual's body. That is, when the side straps 170, 172 are pulled, movement of the breasts is restricted laterally and in and out by the side panels 115-120 and vertically by the first shoulder strap 126 and the second shoulder strap 128 and by the front support system 183. Although the bra 100 is includes a plurality of interconnected elements, it is noted that elements can be eliminated and or separated from each other to act independent of each other.

Although the bra 100 is shown as being fastened at the rear and front thereof, the bra 100 may be complete closed or the connections may be made at a side, just at the front or just at the rear.

FIGS. 8A-10 illustrate another embodiment of an athletic bra 200. The bra 200 includes a front portion 202, a back portion 204, a first side portion 206 that extends between the front portion 202 and the back portion 204 and a second side portion 208 that extends between the front portion 202 and the back portion 204. A band 210 is fixed to a lower end of the front portion 202, the back portion 204 and the side portions 206, 208.

The front portion 202 includes a first front panel 212 and a second front panel 214 that is independent of the first front panel 212 to allow the bra 200 to open at the front thereof (i.e., front entry). The first front panel 212 and the second front panel 214 can each be comprised of a single panel or piece of material or multiple panels or pieces of material that are connected together to form the respective first front panel 212 and second front panel 214. The material can include woven fabric, nonwoven fabric, fabric having moisture wicking capabilities, fabric that at least in part is elastomeric, etc. The pieces of material can be connected to each other by, for example, sewing or bonding the pieces of material to each other. In an embodiment, at least a portion of a piece of material 216, 218 of each of the front panels 212, 214, respectively, includes elastomeric properties to aid in compressing and stabilizing the breasts of an individual wearing the bra 200. Alternatively, the front panels 212, 214 can be comprised of non-stretch material.

Figure 9:
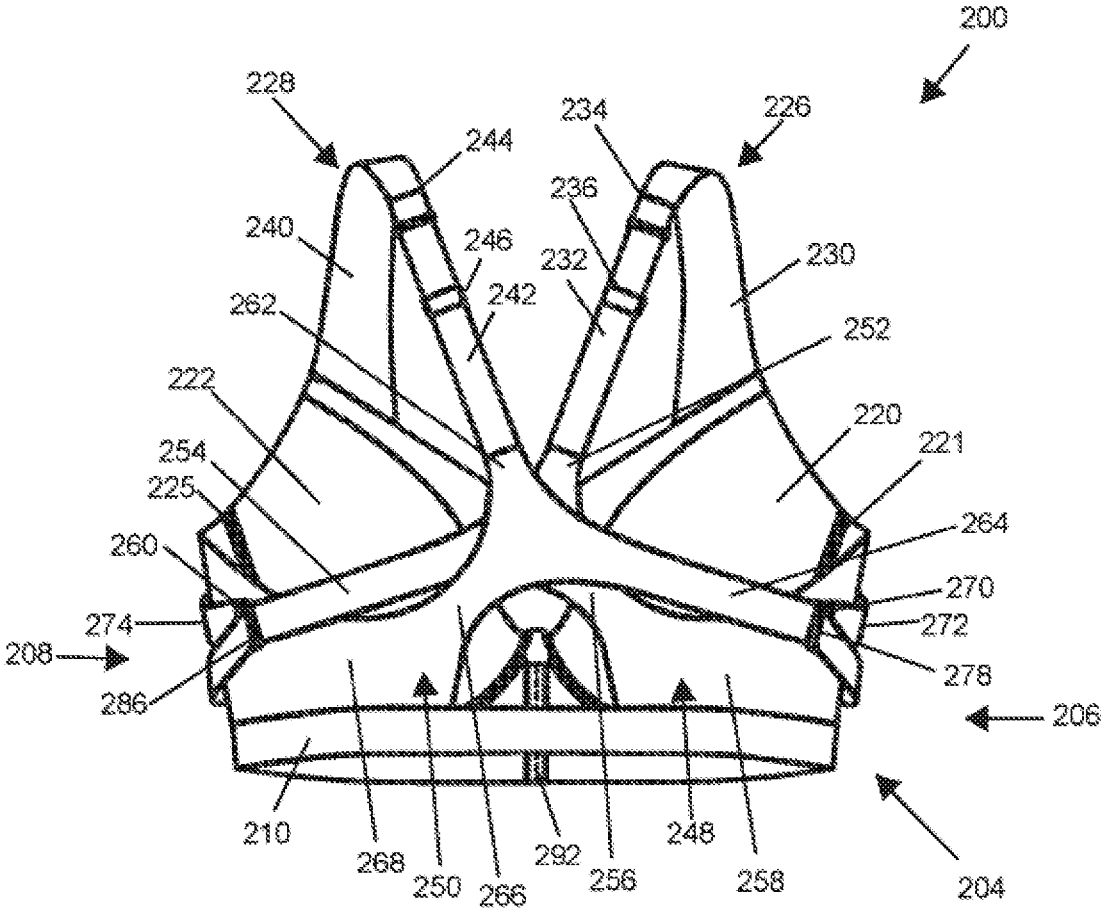
FIG. 9 is a rear view of the bra of FIG. 8A.

As shown in FIG. 9, the front portion 202 can include a first cup 220 that is associated with the first front panel 212 and a second cup 222 that is associated with the second front panel 214. The first and second cups 220, 222 can be molded and fixed to the respective first front panel 212 and the second front panel 214. In an embodiment, the cups 220, 222 can be independent of the first front panel 212 and the second front panel 214. In another embodiment, the cups 220, 222 can be included as part of a modular system whereby the first and second cups 220, 222 are arranged between the respective first and second front panels 212, 214 and a layer of material affixed to an surface of the first and second front panels 212, 214 that is contactable with the breasts and upon securing the bra 200 to a user's body, the modular cups aid in evenly compressing the breasts.

A first shoulder strap 226 and a second shoulder strap 228 that is spaced from the first shoulder strap 226 each extend between the front portion 202 and the back portion 204 of the bra 200. The straps 226, 228 can each be comprised of a single piece of material or segments of material where at least one of the segments that form the straps 226, 228 can at least in part be comprised of a material or blend of materials that include(s) elastomeric or non-elastomeric properties.

In an embodiment, the first shoulder strap 226 includes a first piece of material (or blend of materials) 230 that is not at least substantially comprised of an elastomer to aid in the tensioning of the bra 200 and a second piece of material (or blend of materials) 232 that is comprised at least in part of an elastomer to aid in adjusting the strap 226. The second piece of material 232 is fixed to the first piece of material 230 by a first connection mechanism 234, such as a first loop, and an adjustment mechanism 236, such as a slide, can be arranged on the second piece of material 232 to aid in adjusting the length of the first shoulder strap 226 to ensure a proper, supportive and comfortable fit. Alternatively, the two pieces of material 230, 232 can be directly connected to each other. Like the first shoulder strap 226, the second shoulder strap 228 includes a first piece of material (or blend of materials) 240 that is not at least substantially comprised of an elastomer to aid in the tensioning of the bra 200 and a second piece of material (or blend of materials) 242 that is comprised at least in part of an elastomer to aid in adjusting the strap 228. The second piece of material 242 is fixed to the first piece of material 240 by a second connection mechanism 244, such as a first loop, and an adjustment mechanism 246, such as a slide, can be arranged on the second piece of material 242 to aid in adjusting the length of the second shoulder strap 228 to ensure a proper, supportive and comfortable fit. In another configuration, the connection mechanism 234 and 244 and the adjustment mechanisms 236, 246 can be combined into a single element. In yet another configuration, a single piece of material can be used to form the shoulder straps 226, 228.

The back portion 204 of the bra 200 includes a first back strap system 248 and a second back strap system 250. The first back strap system 248 includes a first leg 252 that is connected to the second end of the first shoulder strap 226, a second leg 254 that extends at a first angle in a first direction from the first leg 252 toward the second side portion 208 and is fixed at a distal end thereof to a slide 260 and a third leg 256 that extends at a second angle from the first leg 252 in a second direction toward the first side portion 206. The third leg 256 extends contiguously at a second end thereof to a first panel 258. The first panel 258 extends from the back portion 204 around the first side portion 206 toward the front portion 202. As can be seen, for example, in FIGS. 8A-8C, the first panel 258 is fixed along a bottom edge thereof to the band 210 and to a sidewall 221 of the first cup 220, but can be connected directly to the cup 220 with the sidewall eliminated from the design. The second back strap system 250 is independent of the first back strap system 248 and a mirror opposite configuration of the first back strap system 248. The second back strap system 250 includes a first leg 262 that is connected to the second end of the second shoulder strap 228, a second leg 264 that extends at a first angle in a first direction from the first leg 262 toward the first side portion 206 and is fixed at a distal end thereof to a slide 270 and a third leg 266 that extends at a second angle from the first leg 262 in a second direction toward the second side portion 208. The third leg 266 extends contiguously at a second end thereof to a second panel 268. The second panel 268 extends from the back portion 204 around the second side portion 208 toward the front portion 202. As can be seen in FIG. 9, the second panel 268 is fixed along a bottom edge thereof to the band 210 and to a sidewall 225 of the second cup 222, but can be connected directly to the cup 222 with the sidewall eliminated from the design. Alternatively, the first back strap system 248 can be connected to the second shoulder strap 228 and the second back system 250 can be connected to the first shoulder strap 226.

The first back strap system 248 and the second back strap system 250 can be made of any material that includes, but is not limited to woven fabric, non-woven fabric, fabric having moisture wicking capabilities, fabric that comprises elastomeric properties, etc.

Figure 8A:
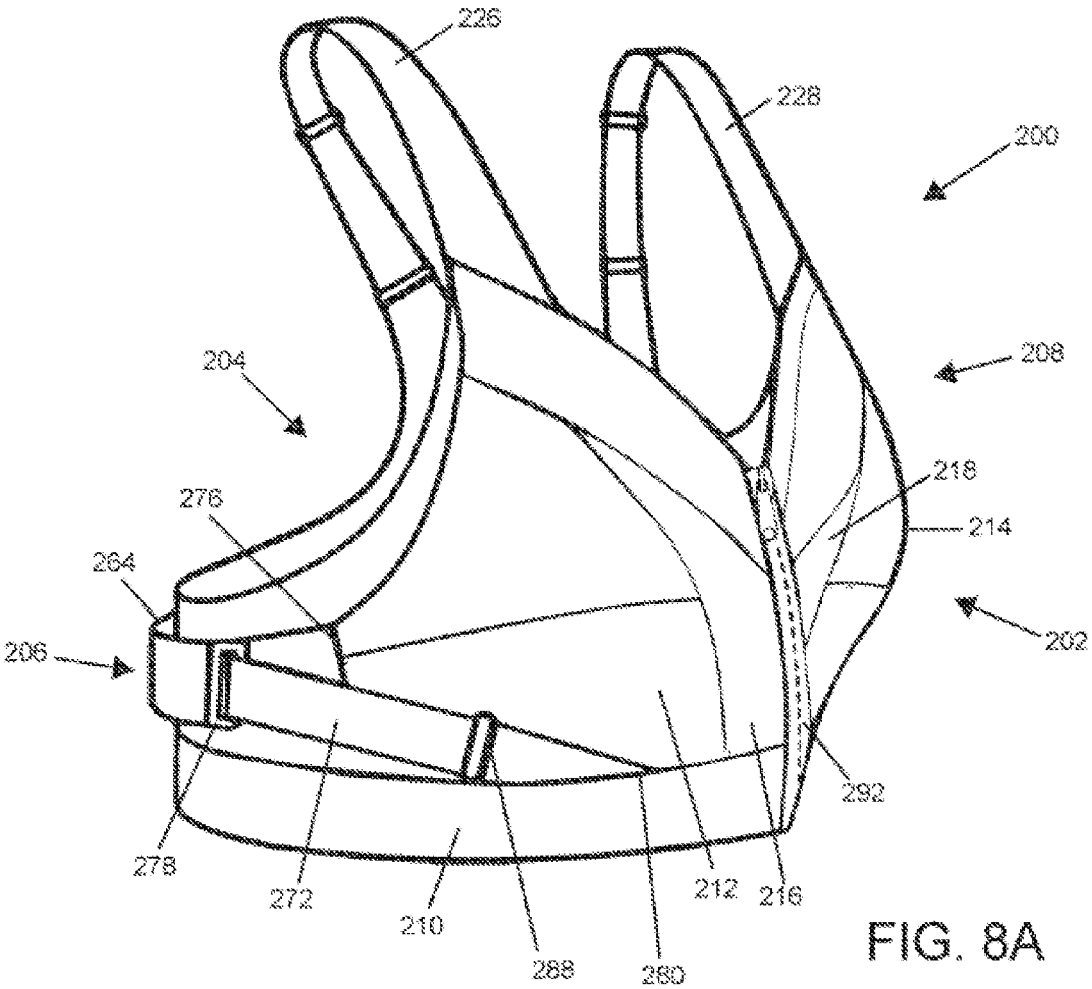
FIG. 8A is a first front perspective view of another embodiment of an adjustable athletic bra the present invention that includes a zipper to allow for opening of the bra at the front.

As depicted in FIGS. 8A-9, the bra 200 includes a first side strap 272 that extends from the first side portion 206 toward the front portion 202 and a second side strap 274 that extends from the second side portion 208 toward the front portion 202. The first side strap 272 is fixed at a first end 276 to the first front panel 212, extends through a slide 278 to connect the first side strap 272 to the second back strap system 250 and is fixed at second end 280 between the band 210 and the first front panel 212. Similarly, the second side strap 274 is fixed at a first end (not shown) to the second front panel 214, extends through a slide 286 to connect the second side strap 274 to the first back strap system 248 and is fixed at second end (not shown) between the band 210 and the second front panel 214. The first side strap 272 and the second side strap 274 can each include a second slide 288, 289, respectively, to aid in adjusting the tension of the bra 200.

Figure 10:
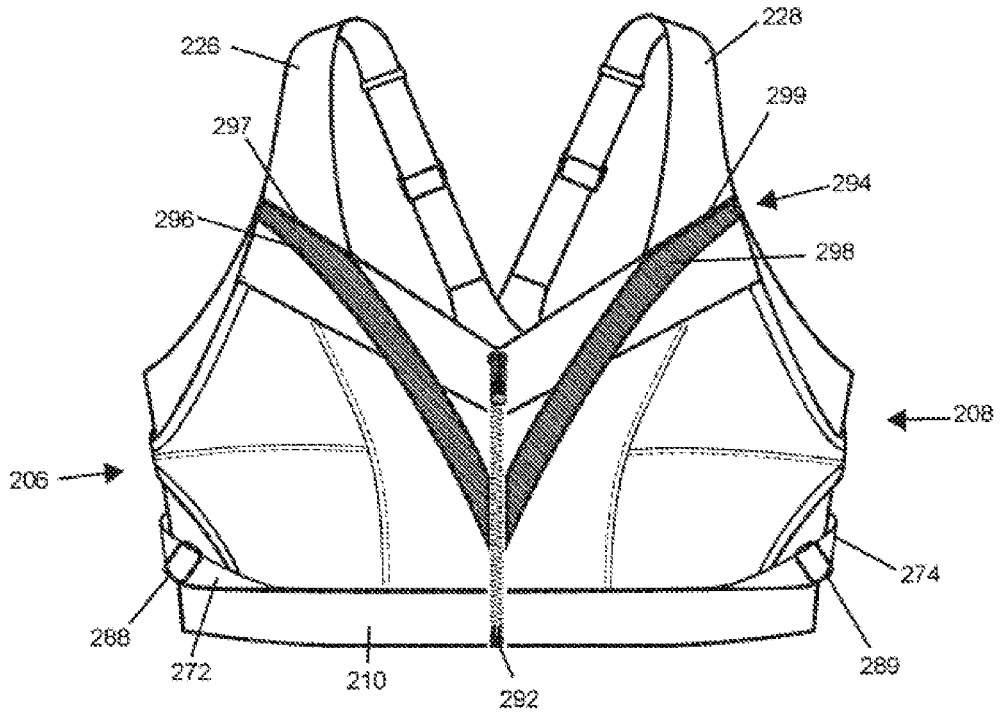
FIG. 10 is a front view of the bra of FIG. 8A showing a support system.
Figure 11:
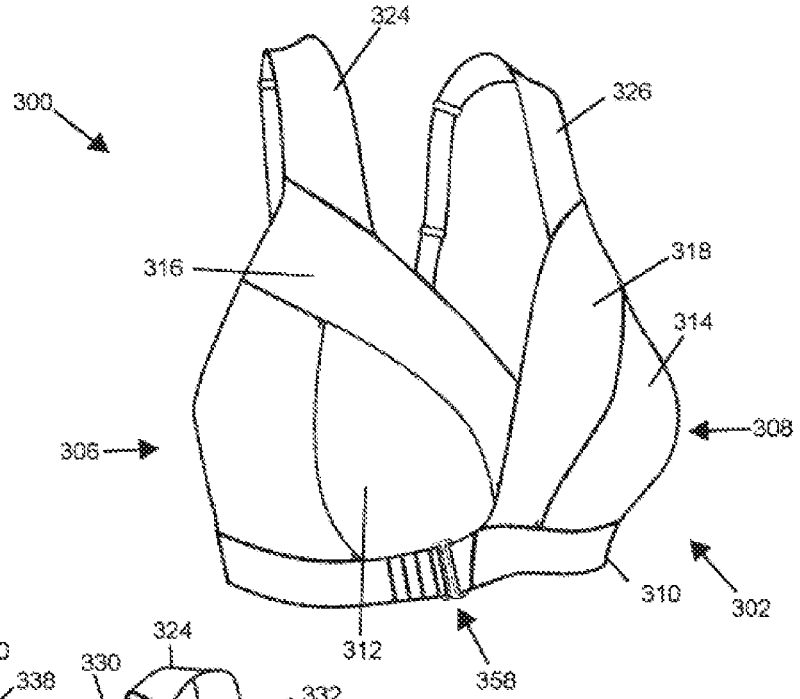
FIG. 11 is a first front perspective view of another embodiment of an adjustable athletic bra the present invention that includes an adjustment features at the front of the bra with the bra depicted in a closed state.

FIG. 10 is a front view of the bra 200 that illustrates a front support system 294, which is comprised of a first piece of material 296 and a second piece of material 298 that is configured to adjust tension across the front portion 202 of the bra 200. The first piece of material 296 and the second piece of material 298 can be independent of each other. In an embodiment, the front support system 294 can be comprised of multiple separate pieces of material that are joined form the first and second piece of material 296, 298. In an embodiment, the first piece of material 296 and the second piece of material 298 are each independently comprised of a single piece of non-elastomeric material, elastomeric material or a blend of non-elastomeric and elastomeric material. In an embodiment where the pieces of material 296, 298 are a blend of elastomeric and non-elastomeric material, the approximately half of each of the first and second pieces of material 296, 298 can be comprised of elastomeric material and the other half can be comprised of non-stretch material. In such a system, the elastomeric material can encompass the upper or lower half of each piece of material 296, 298 to aid in compressing the upper or lower portion of the bra 200 and the upper or lower half of each piece of material 296, 298 can be comprised of non-stretch material to aid in keeping the breasts contained within the 220, 222 cups. As shown in FIG. 10, a first end 297 of the first piece of material 296 can be directly or indirectly fixed to the first shoulder strap 226 and a first end 299 of the second piece of material 298 can be directly or indirectly fixed to the second shoulder strap 228. The front support system 294 can be integrated into a layer of material of the bra 200 or can separate from the bra 200.

The front support system 294 can be adjusted by adjusting the side straps 272, 274. For example, when the first side strap 272 is adjusted (shortened) via the slider 288, the second leg 264 of the second back panel 250 is pulled, tensioning the second shoulder strap 228 and in turn the second piece of material 298 or second side of the front support system 294. Similarly, when the second side strap 274 is adjusted (shortened) via the slider 289, the second leg 254 of the first back panel 248 is pulled, tensioning the first shoulder strap 226 and in turn the first piece of material 296 or first side of the front support system 294.

Figure 8B:
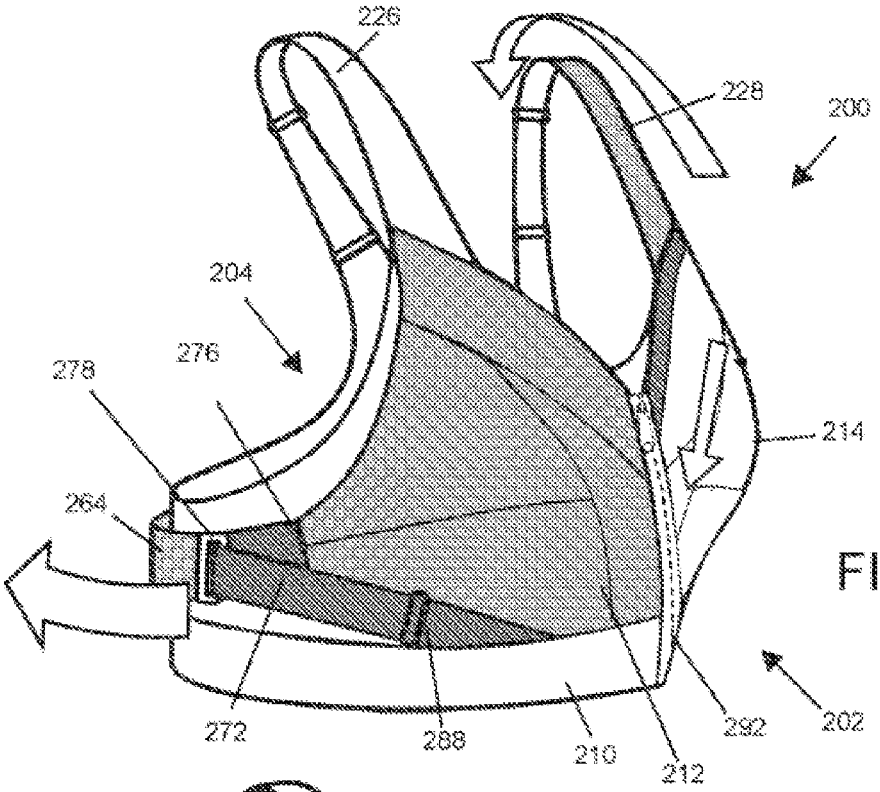
FIG. 8B is a second front perspective view of the bra of FIG. 8A showing the directional tensioning of the bra during use.
Figure 8C:
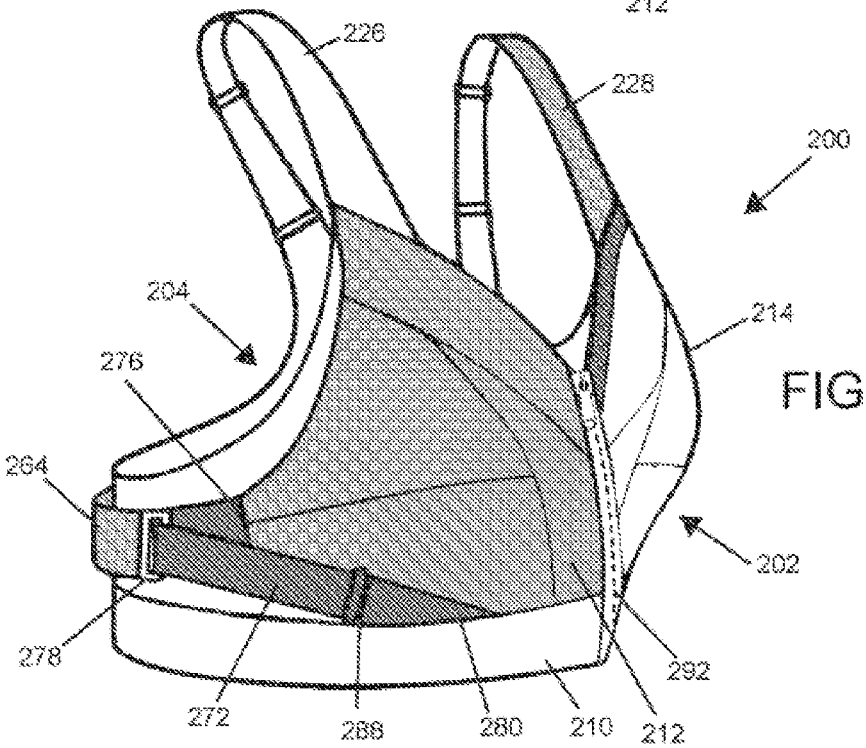
FIG. 8C is a third front perspective view of the bra of FIG. 8A showing the interaction of features of the bra during use.

In order to secure the bra 200 in place and stabilize breast laterally, vertically and in and out (across three axes of movement), the bra 200 includes a front closure mechanism 292 to releasably fix the first front panel 212 to the second front panel 214. As shown in FIGS. 8A and 8B, the front closure mechanism 292 can be a zipper. Although a zipper is shown, the front closure mechanism 292 can be another fastener or fastening system, such as hook and loop fasteners, snaps, buttons, an adhesive or a hook and eye connection, etc. Additionally, it is possible for the bra 200 to be rear entry with the front closure mechanism 292 eliminated from the design.

FIGS. 11-14 illustrate a third embodiment of an athletic bra 300. The bra 300 includes a front portion 302, a back portion 304, a first side portion 306 that extends between the front portion 302 and the back portion 304 and a second side portion 308 that extends between the front portion 302 and the back portion 304. A band 310 is fixed to a lower end of the front portion 302, the back portion 304 and the side portions 306, 308.

The front portion 302 includes a first front panel 312 and a second front panel 314 that is independent of the first front panel 312 to allow the bra 300 to open at the front thereof (i.e., front entry). The first front panel 312 and the second front panel 314 can each be comprised of a single piece or multiple pieces of material that are connected together to form the respective first front panel 312 and second front panel 314. The material can include woven fabric, nonwoven fabric, fabric that includes moisture wicking material, fabric that at least in part is elastomeric, etc. The pieces of material can be connected to each other by, for example, sewing or bonding the pieces of material to each other. In an embodiment, at least a portion of a piece of the material 316, 318 of each of the front panels 312, 314, respectively, includes elastomeric properties to aid in compressing and stabilizing the breasts of an individual wearing the bra 300. In another embodiment, approximately a portion of each of the pieces of the material 316, 318 includes elastomeric properties to aid in compressing and stabilizing the breasts of an individual wearing the bra 300 and another portion of the pieces of the material 316, 318 do not comprise an elastomer to ensure the breasts are contained within the respective front panels 312, 314. Alternatively, the front panels 312, 314 are comprised of non-elastomeric material.

Figure 12:
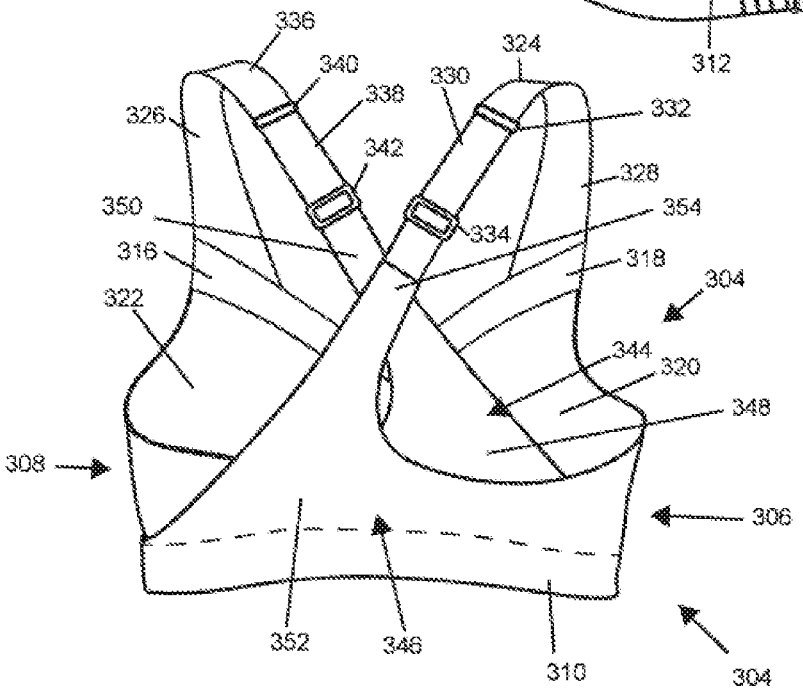
FIG. 12 is a rear view of the bra of FIG. 11.

As illustrated in FIG. 12, the front portion 302 can include a first cup 320 that is associated with the first front panel 312 and a second cup 322 that is associated with the second front panel 314. The first and second cups 320, 322 can be molded to the respective first front panel 312 and the second front panel 314, independent of the first front panel 312 and the second front panel 314 or included as part of a modular system whereby the first and second cups 320, 322 are arranged between the respective first and second front panels 312, 314 and a layer of material affixed to an surface of the first and second front panels 312, 314 that is contactable with the breasts and upon securing the bra 300 to a user's body, the modular cups aid in evenly compressing the breasts. However, in an embodiment, the cups 320, 322 can be removed from the design, can be removable whereby an individual can choose to temporarily remove the cups 320, 322, cannot be included as part of the design or an after-market purchase.

A first shoulder strap 324 and a second shoulder strap 326 that is spaced from the first shoulder strap 324 each extend between the front portion 302 and the back portion 304 of the bra 300. The straps 324, 326 can be comprised of a single piece of material or segments of material where at least one of the segments that form the straps 324, 326 can at least in part be comprised of a material or blend of materials that include(s) elastomeric properties.

As shown, for example, in FIG. 12, the first shoulder strap 324 includes a first piece of material (or blend of materials) 328 that is not at least substantially comprised of an elastomer to aid in the tensioning of the bra 300 and a second piece of material (or blend of materials) 330 that is comprised at least in part of an elastomer to aid in adjusting the strap 324. The second piece of material 330 is fixed to the first piece of material 326 by a first connection mechanism 332, such as a first loop, and an adjustment mechanism 334, such as a slide, can be arranged on the second piece of material 330 to aid in adjusting the length of the first shoulder strap 324 to ensure a proper, supportive and comfortable fit. Alternatively, second piece of material 330 can be non-elastomeric and the first piece of material 328 can be elastomeric. In an embodiment, the connection mechanism 332 can be eliminated. Like the first shoulder strap 324, the second shoulder strap 326 includes a first piece of material (or blend of materials) 336 that is not at least substantially comprised of an elastomer to aid in the tensioning of the bra 300 and a second piece of material (or blend of materials) 338 that is comprised at least in part of an elastomer to aid in adjusting the strap 326. The second piece of material 338 is fixed to the first piece of material 336 by a first connection mechanism 340, such as a first loop, and an adjustment mechanism 342, such as a slide, can be arranged on the second piece of material 338 to aid in adjusting the length of the second shoulder strap 326 to ensure a proper, supportive and comfortable fit. Alternatively, second piece of material 338 can be non-elastomeric and the first piece of material 336 can be elastomeric. In another configuration, the connection mechanism 332, 340 and the adjustment mechanisms 334, 342 can be combined into a single element. In an embodiment, the connection mechanism 340 can be eliminated and a single piece of material or blend of materials can be used to form the shoulder straps 324, 326.

The back portion 304 of the bra 300 includes a first back panel 344 and a second back panel 346. The first back panel 344 includes a body 348 that extends substantially across the back portion 304, is contiguous to the second side portion 308, is fixed at a lower end thereof to the band 310 and includes a leg 350 that extends from the body 344 and that is contiguous to the second shoulder strap 326. The second back panel 346 includes a body 352 that extends substantially across the back portion 304, is contiguous to the first side portion 306, is fixed at a lower end thereof to the band 310 and includes a leg 354 that extends from the body 352 and that is contiguous to the first shoulder strap 324. As can be seen, for example, in FIG. 12, the back panels 344, 346 are mirror opposite configurations of each other and, with the exception of being fixed to the band 310, not connected such that the panels 344, 346 can move, at least in part, independent of each other.

Figure 13:
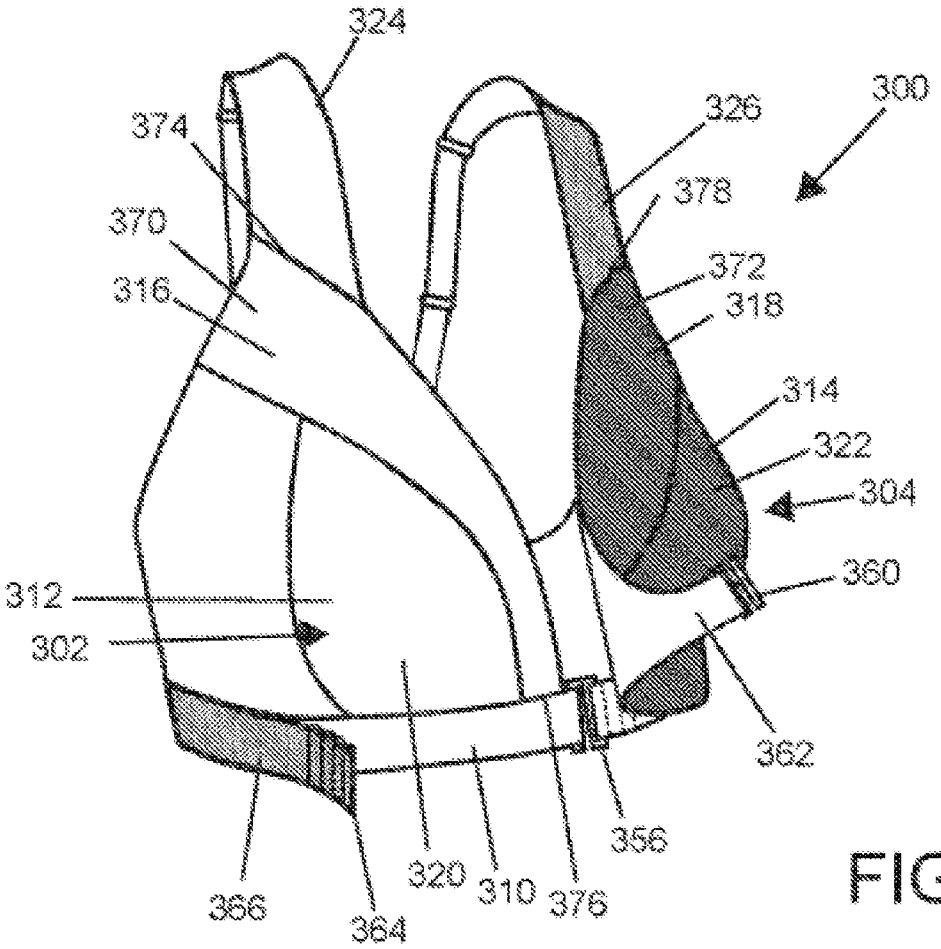
FIG. 13 is a second front perspective view of the bra of FIG. 11 showing the front portion of the bra in an open state.

As shown in FIG. 13, in order to secure the bra 300 in place and stabilize breast laterally, vertically and in and out (across three axes of movement), the bra includes a fastener 356 to first secure the first front panel 312 at a desired position by releasably connecting the first and second ends of the band 310 to each other and a fastening system 358 to secure the second front panel 314 at a desired position, overlapping in part the first front panel 312. The fastening system 358 includes a first fastener element 360 that is fixed to a portion of material 362 that extends from the second front panel 314 and a second fastener element 364 that is fixed to a tab 366 which extends from the band 310.

Figure 14:
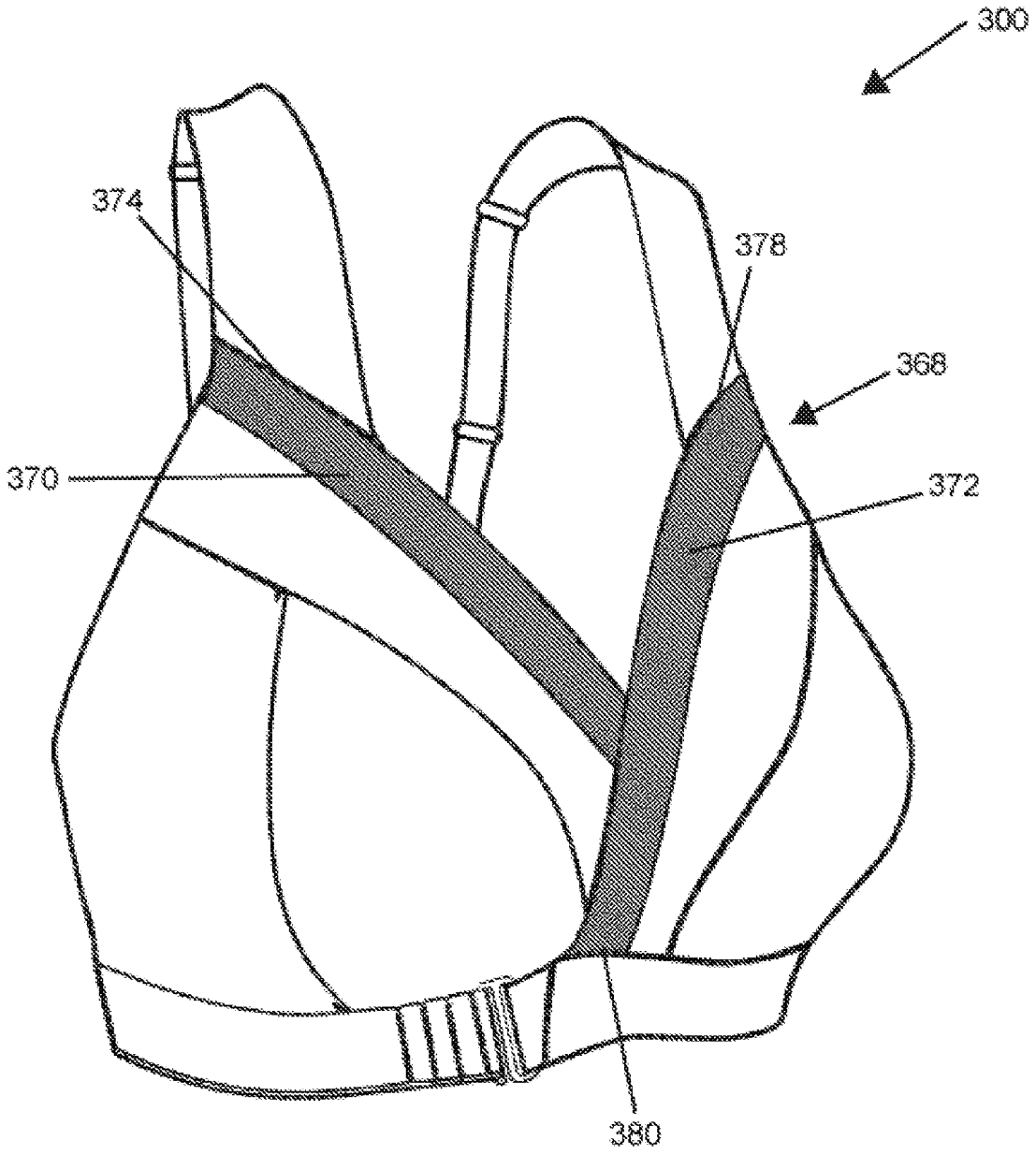
FIG. 14 is a front view of the bra of FIG. 11 showing a support system.
Figure 15A:
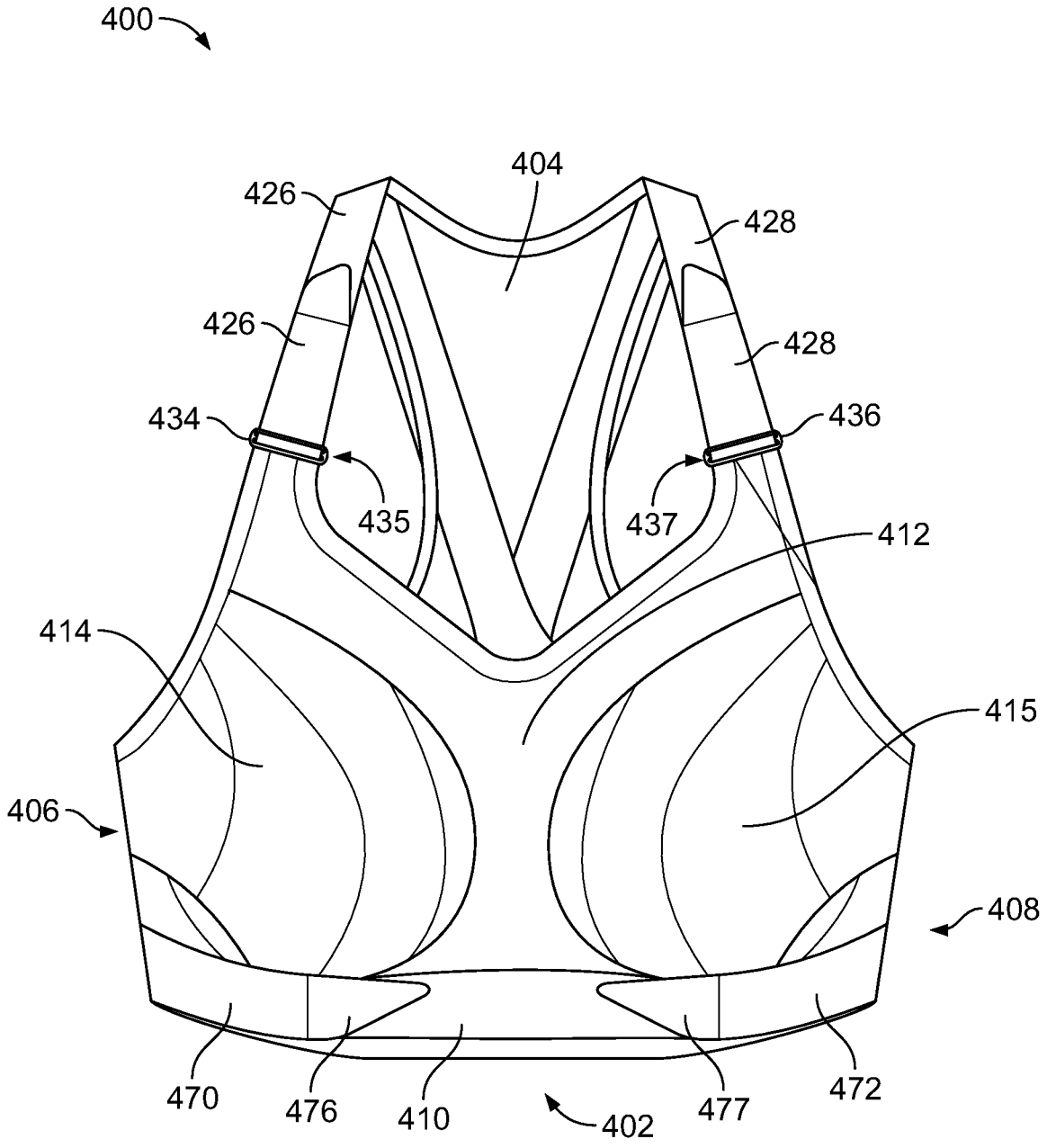
FIGS. 15A-15C are a front views of a sports bra according to another exemplary embodiment of the present invention.
Figure 15B:
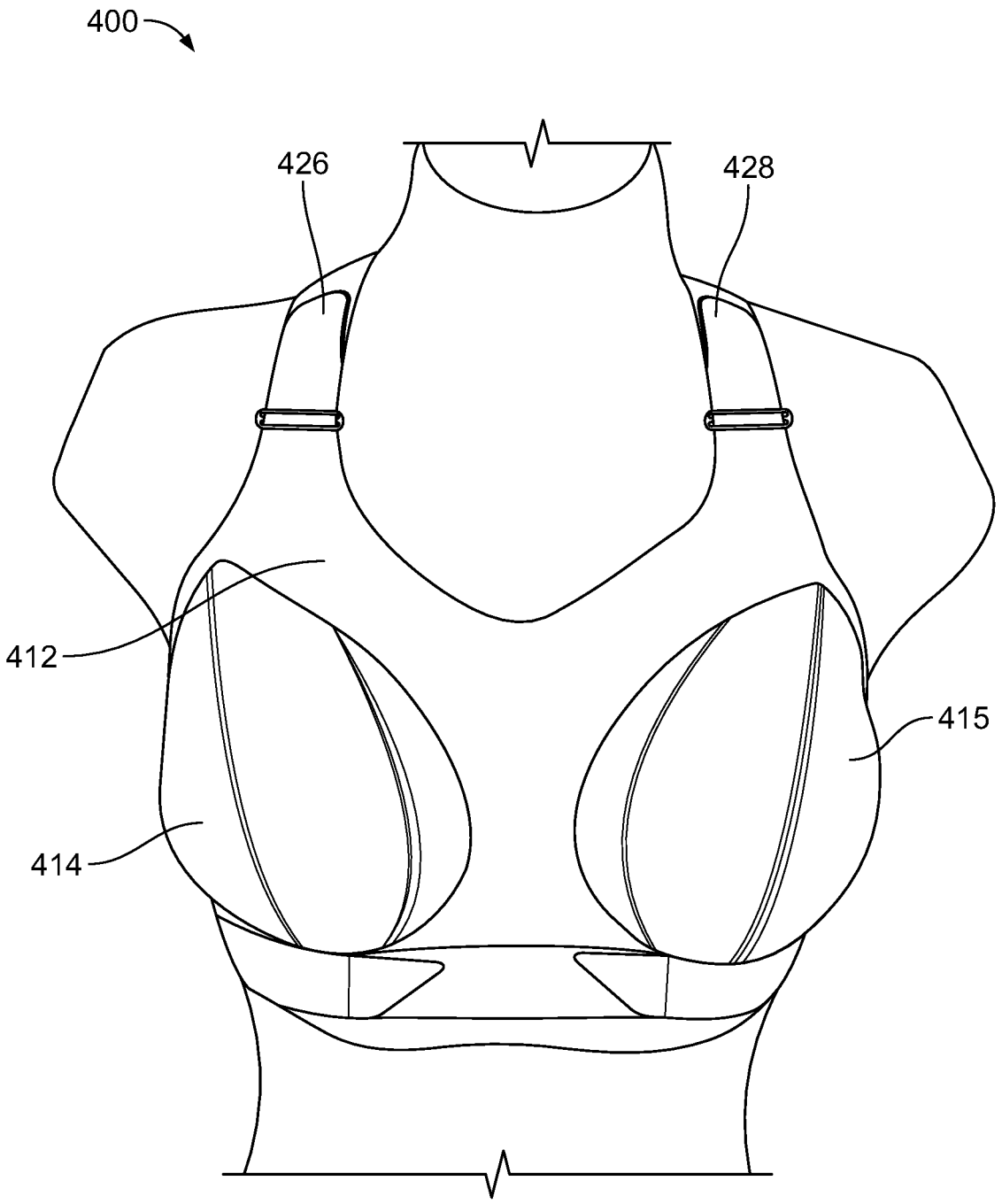
Figure 15C:
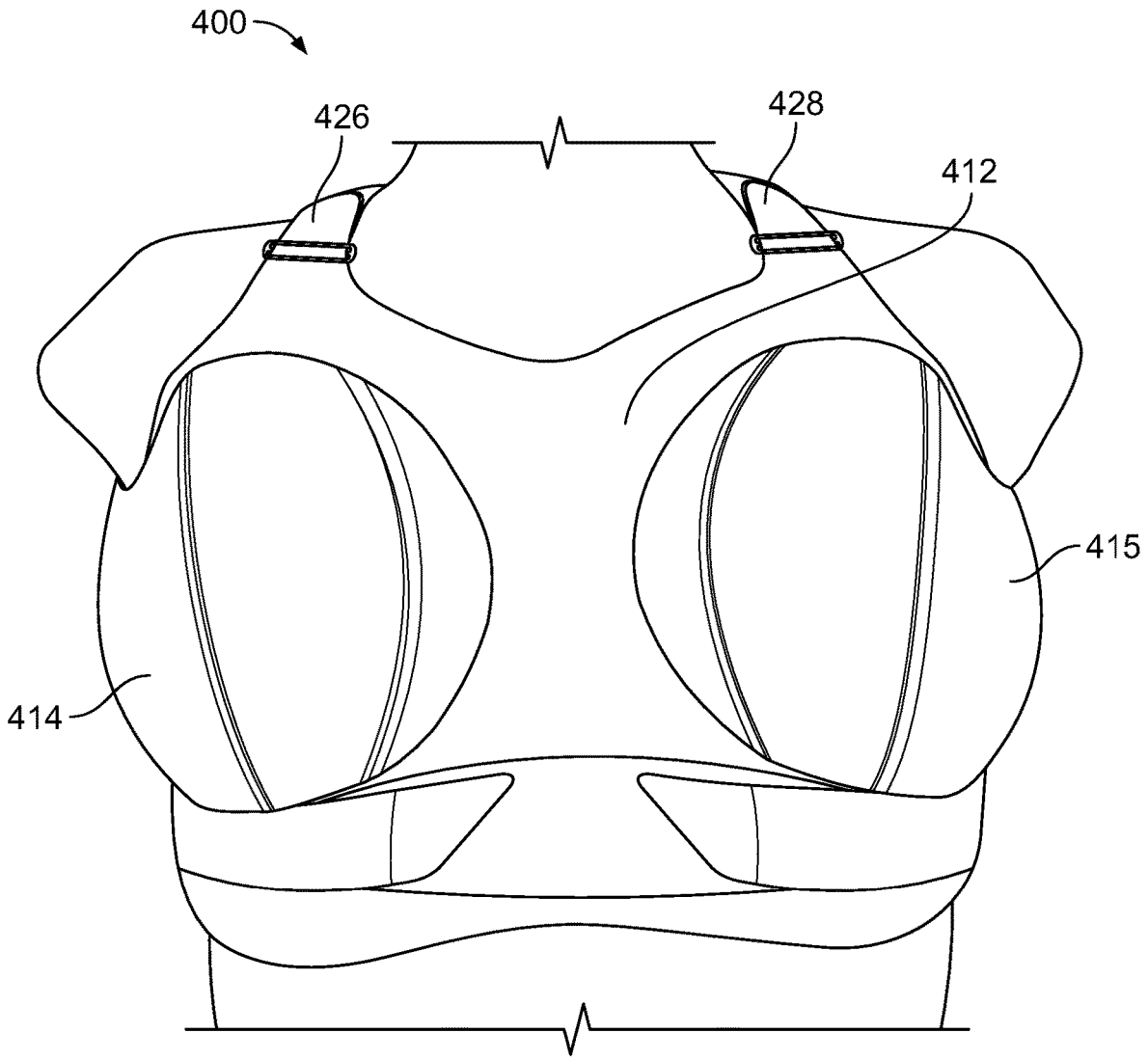

FIG. 14 is a front view of the bra 300 that illustrates a front support system 368, which is comprised of a first piece of material 370 and a second piece of material 372 that is configured to adjust tension across the front portion 302 of the bra 300. The first piece of material 370 and the second piece of material 372 can be independent of each other. In an embodiment, the front support system 368 can be comprised of multiple separate pieces of material that are joined form the first and second piece of material 370, 372. In an embodiment, the first piece of material 370 and the second piece of material 372 are each independently comprised of a single piece of non-elastomeric material, elastomeric material or a blend of non-elastomeric and elastomeric material. In an embodiment where the pieces of material 370, 372 are a blend of elastomeric and non-elastomeric material, the approximately half of each of the first and second pieces of material 370, 372 can be comprised of elastomeric material and the other half can be comprised of non-stretch material. In such a system, the elastomeric material can encompass the upper or lower half of each piece of material 370, 372 to aid in compressing the upper portion of the bra 300 and the upper or lower half of each piece of material 370, 372 can be comprised of non-stretch material to aid in keeping the breasts contained within the 320, 322 cups. As shown in FIG. 14, the first piece of material 370 extends between a first end 374 and a second end 376 and the second piece of material 372 extends between a first end 378 and a second end 380. The first end 374 of the first piece of material 370 can be directly or indirectly fixed to the first shoulder strap 324 and the second end 376 of the first piece of material 370 can be directly or indirectly fixed to the band 310. The first end 378 of the second piece of material 372 can be directly or indirectly fixed to the second shoulder strap 326 and the second end 380 of the second piece of material 372 can be directly or indirectly fixed to the band 310. The front support system 368 can be integrated into a layer of material of the bra 300 or can separate from the bra 300. FIGS. 15A-24 depict another embodiment of an athletic bra 400. The bra 400 generally includes a front portion 402, a rear portion 404, a first side, or left side, portion 406 that extends between a first end of the front portion 402 and a first end of the rear portion 404 and a second side, or right side, portion 408 that extends between a second end of the front portion 402 and a second end of the rear portion 404.

The front portion 402 can comprise a compression layer that can be a single piece of material that has a low modulus of elasticity and is molded to include a first cup and a second cup or a plurality of layers of material that include a central support layer 412, a first cup layer 414 and a second cup layer 415. Each layer 412, 414, 415 can be comprised, for example, of woven fabric, nonwoven fabric, synthetic fabric, fabric that includes moisture wicking capabilities, webbing and/or fabric that, at least in part, is elastomeric. In an embodiment, the central support layer 412 can be comprised of a material that does not stretch vertically between the cup layers 414, 415, but can include elastomeric properties to allow for limited stretching capabilities horizontally. In other words, in an embodiment, the central support layer 412 includes a material that is substantially not elastic in the vertical direction but is slightly elastic in the horizontal direction. Thus, it is understood that the elastic material of the central support layer 412 is more stretchable in a horizontal direction than in a vertical direction. The cup layers 414, 415 can be comprised of a material that allows for limited stretching both vertically and horizontally. Thus, the cup layers 414, 415, may be slightly elastic in both the horizontal and vertical directions in order to more evenly support a wearer's breasts. The elasticity of the cup layers 414, 415 may be the same in the vertical and horizontal directions, or the cup layers 414, 415 may be, for example, more elastic (e.g., more stretchable) in the horizontal direction than in the vertical direction, or more elastic in the vertical direction or horizontal direction. Additionally, the layers 412, 414, 415 can be coated to increase and/or decrease their modulus of elasticity. The support layer 412 and the cup layers 414, 415 can be connected to each other by, for example, sewing or bonding the layers 412, 414, 415 to each other. At the base (or bottom) of the bra 400, a band 410 extends about at least the front portion 402 and the side portions 406, 408 of the bra 400. The band 410 can be comprised of an elastomeric (e.g., elastic) material to allow for adaptability and to aid in compression of the bra 400 to various individual's bodies. Thus, due to the configuration of the front portion 402, the front portion 402, and more particularly, the central support layer 412, may be configured to lay as close as possible to the user's sternum in order to provide increased comfort and support during physical activity and/or rest.

A first shoulder strap 426 and a second shoulder strap 428 that is spaced from the first shoulder strap 426 each extend between the front portion 402 and the rear portion 404 of the bra 400. To maintain structure and integrity when tensioned, the straps 426, 428 are comprised of material that at least substantially does not contain elastomeric properties that would allow for the straps 426, 428 to stretch. In other words, the straps 426, 428 may not stretch when subjection to tensile forces. For example, the shoulder straps 426, 428 can be made of woven fabric, non-woven fabric, synthetic fabric or fabric that includes moisture wicking capabilities.

Figure 23:
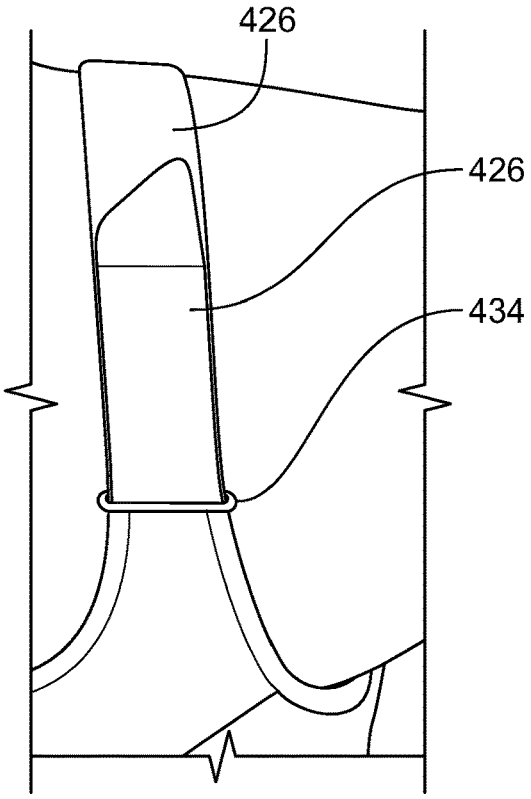
FIGS. 23 and 24 are details of the shoulder straps of the bra of FIG. 15 according to an exemplary embodiment of the present invention.
Figure 24:
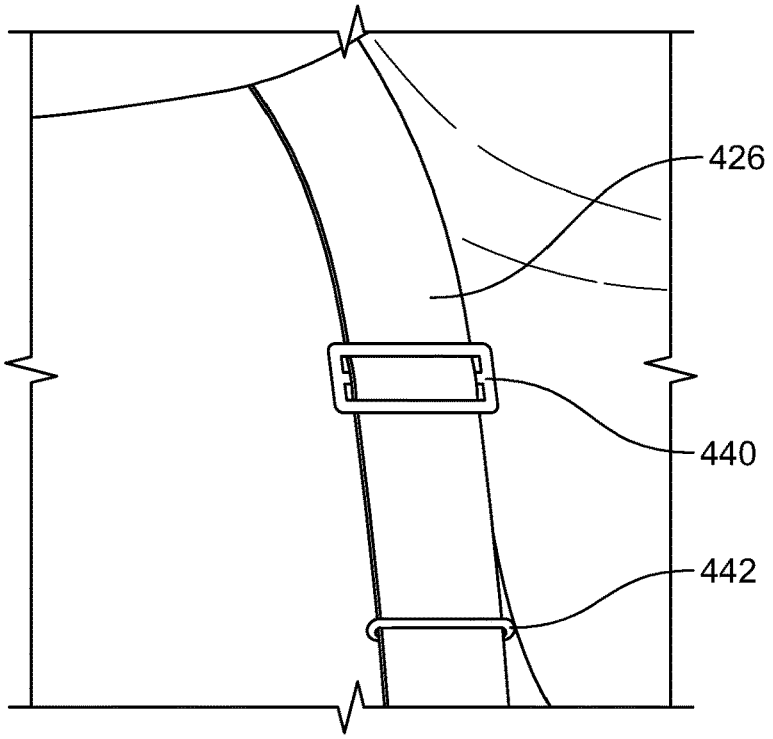

The first shoulder strap 426 can be adjusted by a first connection mechanism 434 such as a clasp that is fixed to the front portion 402 of the bra 400 and includes a first loop 435 through which the first shoulder strap 426 can be fed. In an embodiment as shown in FIG. 23, the first shoulder strap 426 can be pulled to a desired tightness and releasably fixed on itself, for example, by a hook and loop fastener, button, snap or the like. Alternatively, as seen in an embodiment in FIG. 24, the first shoulder strap 426 can be adjusted by a first connection mechanism 440 such as a slider that is positioned on the first shoulder strap 426 with an end of the shoulder strap 426 fixed to a second connection mechanism 442, such as a clasp, fixed to the front portion 402 of the bra 400 and an end of the first shoulder strap 426. Like the first shoulder strap 426, the second shoulder strap 428 can be adjusted by a second connection mechanism 436, such as a clasp that is fixed to the front portion 402 of the bra 400 and includes a first loop 437 through which the second shoulder strap 428 can be fed. In an embodiment, the second shoulder strap 428 can be pulled to a desired tightness and releasably fixed on itself, for example, by a hook and loop fastener, button, snap or the like similar to the first shoulder strap 426. Alternatively, like the first shoulder strap 426, the second shoulder strap 428 can be adjusted by a first connection mechanism (not shown), such as a slider that is positioned on the second shoulder strap 428 with an end of the second shoulder strap 428 fixed to a second connection mechanism (not shown), such as a clasp, fixed to the front portion 402 of the bra 400 and an end of the second shoulder strap 428.

Figure 16:
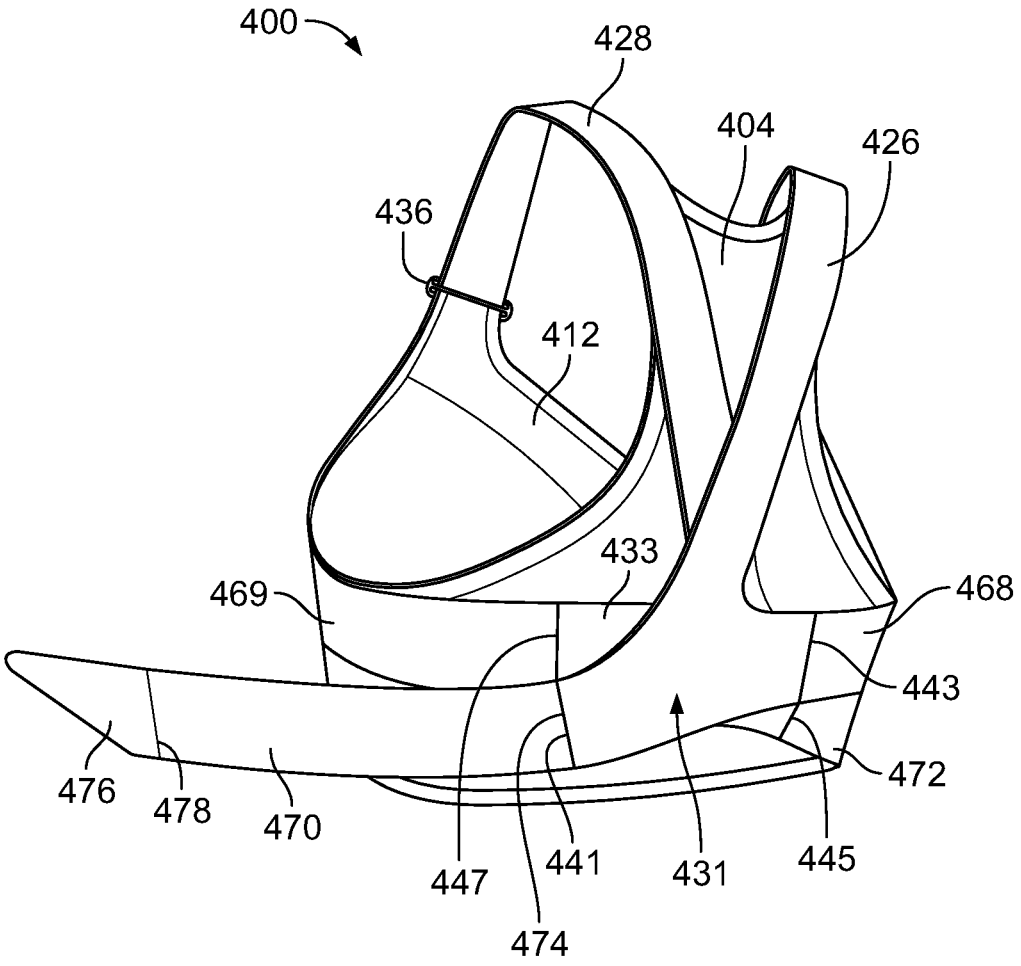
FIG. 16 is rear perspective view of the bra of FIG. 15 according to an exemplary embodiment of the present invention.
Figure 17:
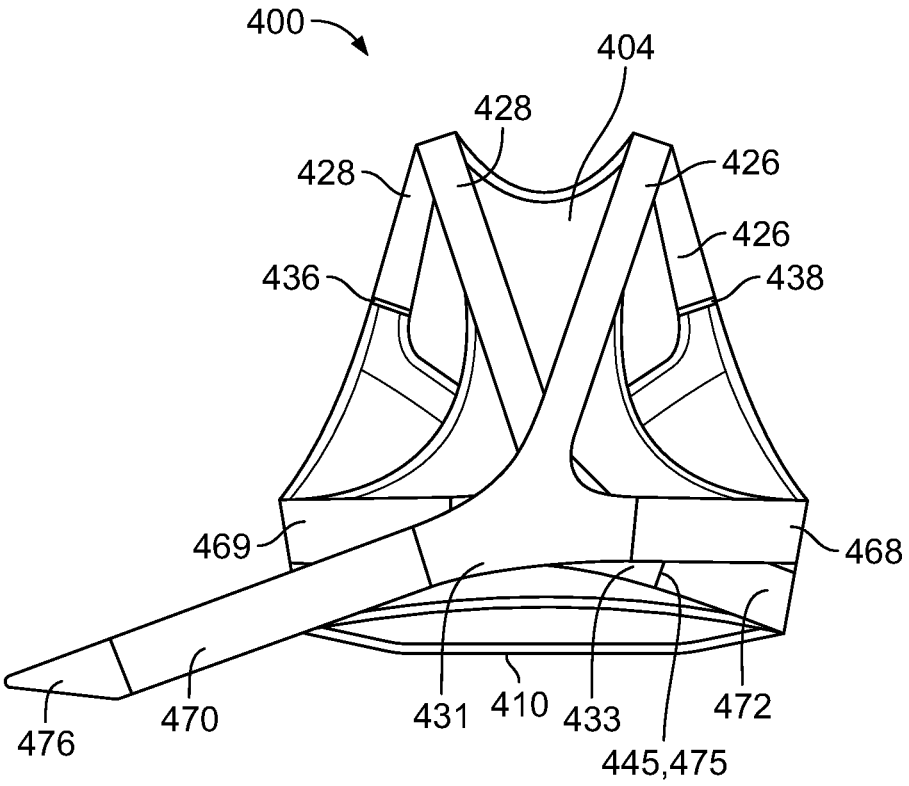
FIG. 17 is rear perspective view of the bra of FIG. 15 according to an exemplary embodiment of the present invention.
Figure 18:
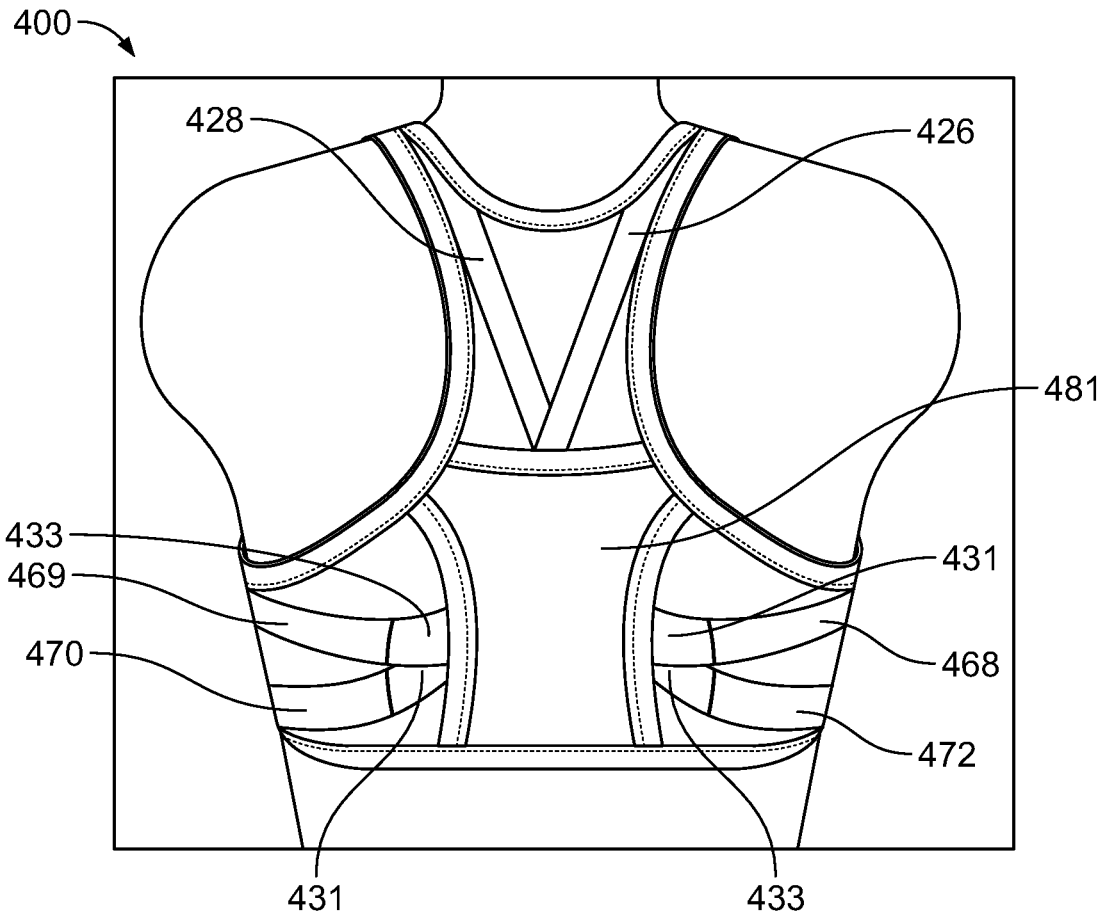
FIG. 18 is another rear perspective view of the bra of FIG. 15 according to an exemplary embodiment of the present invention.
Figure 19:
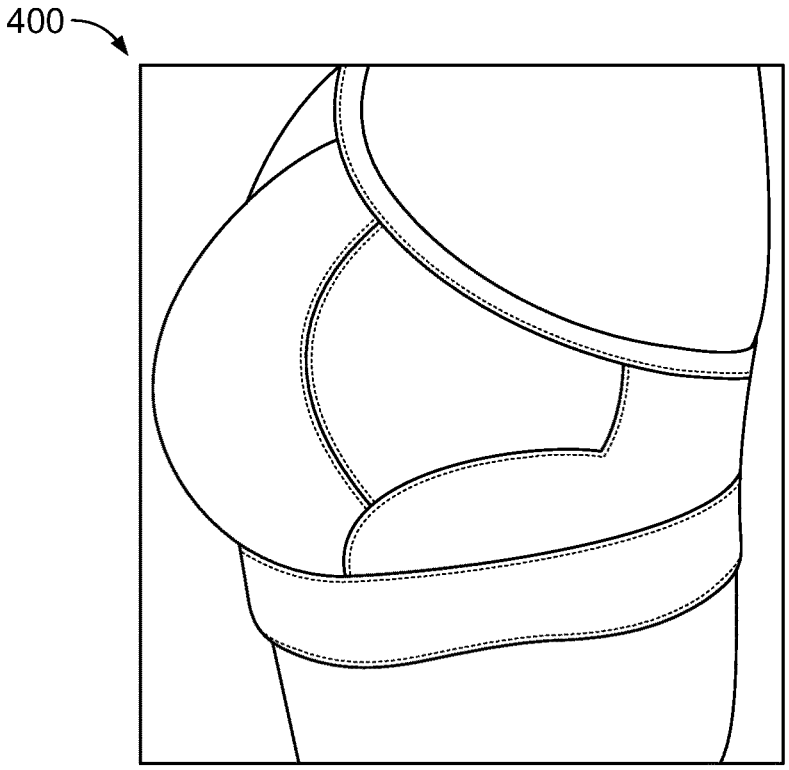
FIG. 19 is a first side view of the bra of FIG. 15 according to an exemplary embodiment of the present invention.
Figure 20:
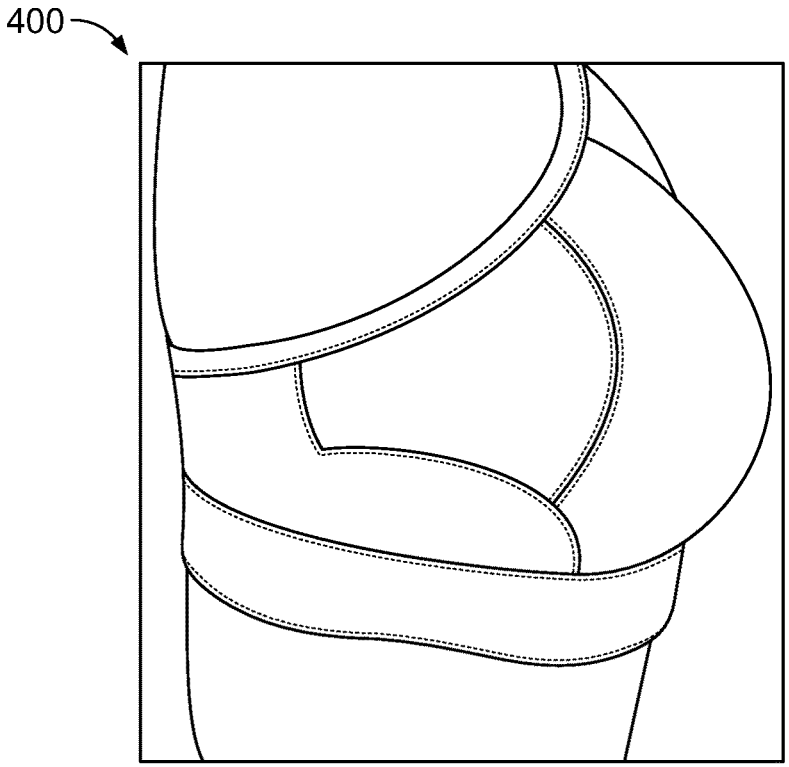
FIG. 20 is a second side view of the bra of FIG. 15 according to an exemplary embodiment of the present invention.
Figure 21:
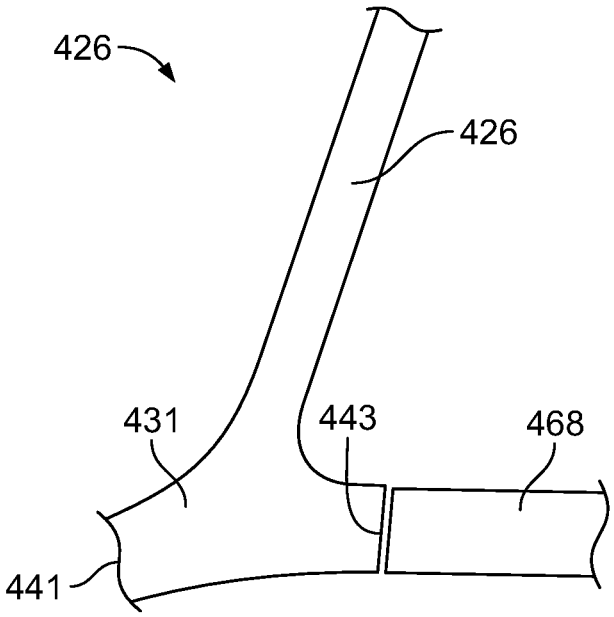
FIG. 21 is a detail view of a portion of the strap of the bra of FIG. 15 according to an exemplary embodiment of the present invention.

As depicted, for example, in FIGS. 16-18, the shoulder straps 426, 428 extend from the front portion 402 of the bra 400 to the rear portion 404 of the bra 400 and can cross over each other. The first shoulder strap 426 and the second shoulder strap 428 both form a Y-shape at their second ends 431, 433, respectively. The first shoulder strap 426 is delimited at the rear of the bra 400 at a first rear end 441 and a second rear end 443. The second shoulder strap 428 is delimited at the rear of the bra 400 at a first rear end 445 and a second rear end 447.

A first side strap 468 (see FIGS. 16-17, 21) extends between the first cup layer 414 and the second rear end 443 of the first shoulder strap 426, and a second side strap 469 extends between the second cup layer 416 and the second rear end 447 of the second shoulder strap 428. The first and the second side straps 468, 469 can be comprised of an elastomeric material to allow for adaptability and to aid in compression of the bra 400 to various individual's bodies. In other words, the first and the second side straps 468, 469 may be elastic (stretchable). A third side strap 470 and a fourth side strap 472 are configured to aid in compressing the bra 400. The third side strap 470 is fixed at a first end 474 thereof to the first rear end 441 of the first shoulder strap 426, is configured to extend around the first side portion 406 and to be selectively fixed via a fastener 476, such a hook and loop fastener, that extends from a second end 478 thereof to aid in securing the third side strap 470 to the band 410 at the front of the bra 400. The fourth side strap 472 is fixed at a first end 475 to the first rear end 445 of the second shoulder strap 428, is configured to extend around the second side portion 408, and is selectively fixable via a fastener 477, such a hook and loop fastener, that extends from a second end 479 thereof to aid in securing the fourth side strap 472 to the band 410 at the front of the bra 400. It is contemplated that the connection can be made using buttons, snaps, sliders, hooks, ties or any other means that allows for a selective, adjustable and secure connection. The third side strap 470 may be elastic, or substantially non-elastic (e.g., non-stretchable). The fourth side strap 472 may be elastic, or substantially non-elastic (e.g., non-stretchable).

The first shoulder strap 426, first side strap 468, and the third side strap 470 may form a first back strap system. The first back strap system may include a first leg (e.g., the first shoulder strap 426), a second leg (e.g., the first side strap 468), and a third leg (e.g., the third side strap 470). The first to third legs of the first back strap system may be interconnected to one another, for example, as shown in FIG. 17, at the area indicated by reference numeral 431.

The second shoulder strap 428, the fourth side strap 472 and the second side strap 469 may form a second back strap system. The second back strap system may include a fourth leg (e.g., the second shoulder strap 428), a fifth leg (e.g., the fourth side strap 472), and a sixth leg (e.g., the second side strap 469). The fourth to sixth legs of the second back strap system may be interconnected to one another, for example, as shown in FIG. 16, at the area indicated by reference numeral 433.

As shown in FIG. 17, the first back strap system may be configured to have a mirror arrangement with respect to the first back strap system.

Figure 22:
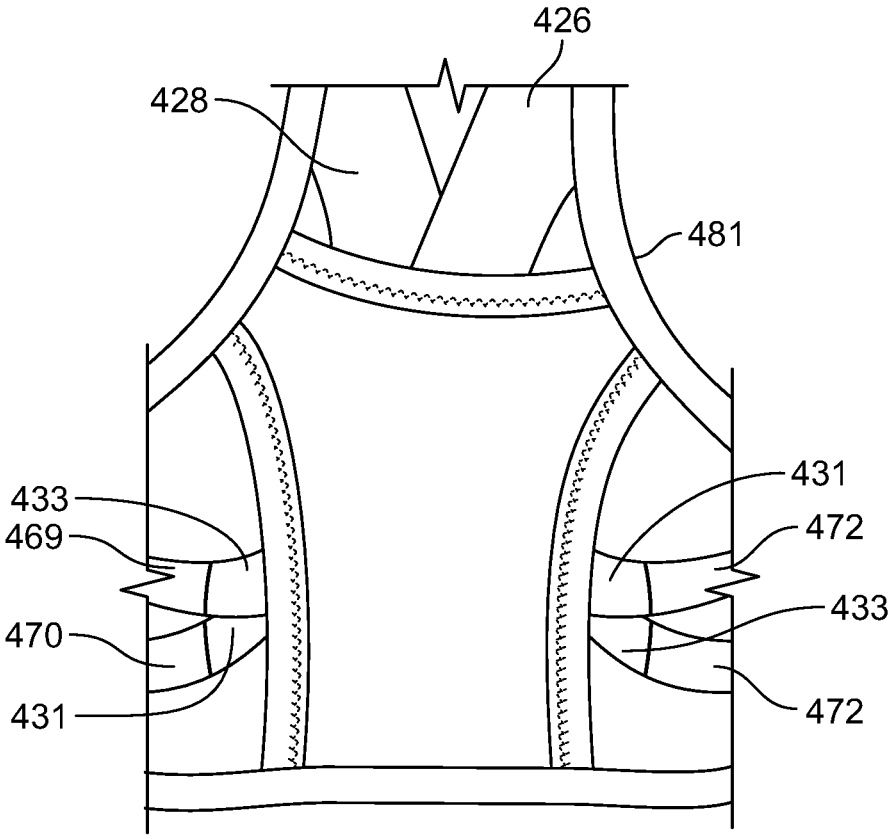
FIG. 22 is a detail view of a rear portion of the bra of FIG. 15 according to an exemplary embodiment of the present invention.

As depicted in FIG. 22, a covering 481 can be affixed (e.g., stitched) to the rear portion 404 of the bra 400 and allows for the shoulder straps 426, 428 to slide between the rear portion 404 and the cover 481.

As illustrated in FIGS. 25-34, to adjust tension across the front portion 402 of the bra 400, the bra 400 can include a support system 500, 600, 700, 800, 900, 1000, 1100, 1200, 1300, 1400 that has adjustment element 502, 602, 702, 802, 902, 1002, 1102, 1202, 1302, 1402 that is configured to prevent upward motion of breasts and integrate the front of the bra 400 with the back portion 406 of the bra 400.

Figure 25:
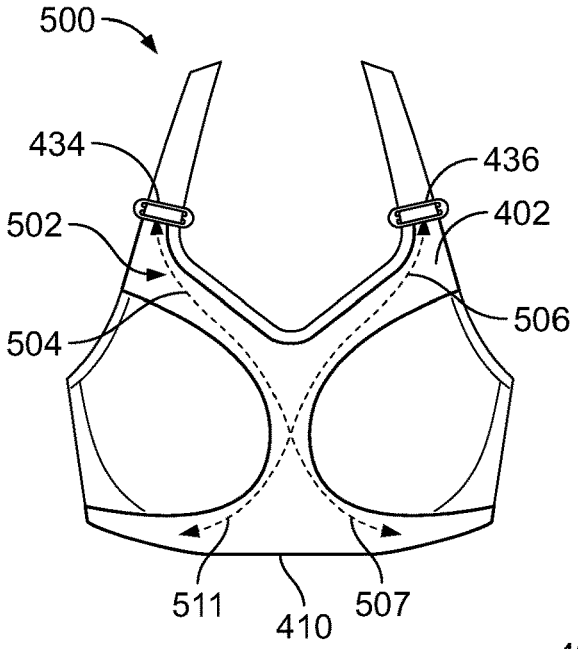
FIGS. 25-34 are various versions a front view of the bra of FIG. 15 showing a support mechanism according to exemplary embodiments of the present invention.

As shown in FIG. 25, the support system 500 can be integrated into the front portion 402 of the bra 400 or, as shown in FIGS. 26-34, the support system 600, 700, 800, 900, 1000, 1100, 1200, 1300, 1400 can be a separate element(s) from the front portion 402 and bra 400 that are fixed thereto.

As shown in FIG. 25, the support system 500 may include a first tensioning element 504 and a second tensioning element 506 (both tensioning elements 502 and 504 are illustrated in hidden line in FIG. 25 to indicate that they are disposed within the front portion 402). The first tensioning element 504 may extend from the first connection mechanism 434 to the band 410 (e.g., to a first point 507 along the band 410). The second tensioning element 506 may extend from the second connection mechanism 436 to the band 410 (e.g., to a second point 511 along the band 410).

Each of the first and second tensioning elements 504 and 506 may be made of an elastic material, for example, of webbing, an elastic string, an elastic ribbon, or other material having elastic properties. The tensioning of the first and second tensioning elements 504 and 506 during the action of fitting (e.g., tightening) the bra 400 results in stabilizing of the first cup layer 414 and second cup layer 415 in position, and may provide tension across the top of the breasts, thus preventing upward movement.

Since the band 410 is tightened when the bra 400 is fitted (e.g., the band 410 is tensioned around the wearer's torso), the band 410 provides a secure attachment point for the first and second tensioning elements 504 and 506 such the that first and second tensioning elements 504 and 506 can provide added comfort and stability to the wearer's breasts during motion or other types of fast movements.

As shown at least in FIGS. 26-34 the support system 600, 700, 800, 900, 1000, 1100, 1200, 1300, 1400 can include a first tensioning element 604, 704, 804, 904, 1004, 1104, 1204, 1304, 1404 and a second tensioning element 606, 706, 806, 906, 1006, 1106, 1206, 1306, 1406 that are independent of each other with the first piece of material 604, 704, 804, 904, 1004, 1104, 1204, 1304, 1404, affixed at a first end 605, 705, 805, 905, 1005, 1105, 1205, 1305, 1405 to the first connection mechanism 434, and connected at a second end 607, 707, 807, 907, 1007, 1107, 1207, 1307, 1407 to the band 410 of the bra 400, and the second tensioning element 606, 706, 806, 906, 1006, 1106, 1206, 1306, 1406 affixed at a first end 609, 709, 809, 909, 1009, 1109, 1209, 1309, 1409 to the second connection mechanism 436 and connected at a second end 611, 711, 811, 911, 1011, 1111, 1211, 1311, 1411 to the band 410 of the bra 400.

Each of the first tensioning elements 604, 704, 804, 904, 1004, 1104, 1204, 1304, 1404 may include the same material as, or a different elastic material from, the first tensioning element 504. Each of the second tensioning elements 606, 706, 806, 906, 1006, 1106, 1206, 1306, 1406 may include the same material as, or a different elastic material from, the second tensioning element 506.

In an embodiment, the first tensioning element 504, 604, 704, 804, 904, 1004, 1104, 1204, 1304, 1404 and the second tensioning element 506, 606, 706, 806, 906, 1006, 1106, 1206, 1306, 1406 can each be comprised of a single piece of elastomeric material. Alternatively, the first tensioning element 504, 604, 704, 804, 904, 1004, 1104, 1204, 1304, 1404 and the second tensioning element 506, 606, 706, 806, 906, 1006, 1106, 1206, 1306, 1406 can be comprised of a blend of non-elastomeric and elastomeric material. In such an embodiment, the approximately a portion of each of the first tensioning element 504, 604, 704, 804, 904, 1004, 1104, 1204, 1304, 1404 and the second tensioning element 506, 606, 706, 806, 906, 1006, 1106, 1206, 1306, 1406 can be comprised of elastomeric material and the other portion can be comprised of non-stretch material. Alternatively, the first tensioning element 504, 604, 704, 804, 904, 1004, 1104, 1204, 1304, 1404 and the second tensioning element 506, 606, 706, 806, 906, 1006, 1106, 1206, 1306, 1406 can be independent of each other and connectable directly to each other (e.g., hook and loop system) or the first tensioning element 504, 604, 704, 804, 904, 1004, 1104, 1204, 1304, 1404 and the second tensioning element 506, 606, 706, 806, 906, 1006, 1106, 1206, 1306, 1406 can be fixed to each other.

As can be seen in FIGS. 25-34, the first tensioning element 504, 604, 704, 804, 904, 1004, 1104, 1204, 1304, 1404 and the second tensioning element 506, 606, 706, 806, 906, 1006, 1106, 1206, 1306, 1406 of the support system 500, 600, 700, 800, 900, 1000, 1100, 1200, 1300, 1400 can cross one or more times or not at all. If the first tensioning element 504, 604, 704, 804, 904, 1004, 1104, 1204, 1304, 1404 and the second tensioning element 506, 606, 706, 806, 906, 1006, 1106, 1206, 1306, 1406 do not cross each other, each tensioning element can, for example, be connected by an opening through which each tensioning element extends, can be fixed at a point to each other or the lower ends of the pieces of material can meet each other creating a V-shape.

The first tensioning element 504, 604, 704, 804, 904, 1004, 1104, 1204, 1304, 1404 and the second tensioning element 506, 606, 706, 806, 906, 1006, 1106, 1206, 1306, 1406 can cross at any point about the front 402 of the bra 400. For simplicity, the figures show the pieces of material meeting at the center of the bra 400, but they can meet higher or lower about the structure of the bra 400. If the lower ends of the first tensioning element 504, 604, 704, 804, 904, 1004, 1104, 1204, 1304, 1404 and the second tensioning element 506, 606, 706, 806, 906, 1006, 1106, 1206, 1306, 1406 do not meet each other, they may be affixed at any point along the bottom band 410, or continue along the bottom band 410 and affix to the side or back area of the bra 400. If the second end 607, 707, 807, 907, 1007, 1107, 1207, 1307, 1407 of the first tensioning element 604, 704, 804, 904, 1004, 1104, 1204, 1304, 1404 and the second ends 611, 711, 811, 911, 1011, 1111, 1211, 1311, 1411 the second tensioning element 606, 706, 806, 906, 1006, 1106, 1206, 1306, 1406 meet each other, they may be fixed to the band 410 or threaded through an object fixed to the bra 400 (i.e. a ring). Alternatively, the second end 607, 707, 807, 907, 1007, 1107, 1207, 1307, 1407 of the first tensioning element 604, 704, 804, 904, 1004, 1104, 1204, 1304, 1404 and the second ends 611, 711, 811, 911, 1011, 1111, 1211, 1311, 1411 the second tensioning element 606, 706, 806, 906, 1006, 1106, 1206, 1306, 1406 can be tethered to the bottom band 410 via a secondary leg (i.e. webbing or elastic).

Figure 26:
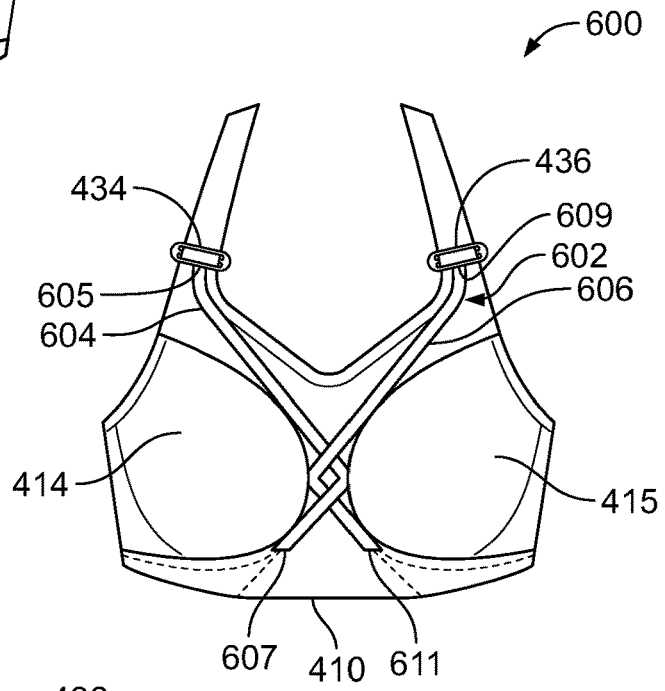
Figure 27:
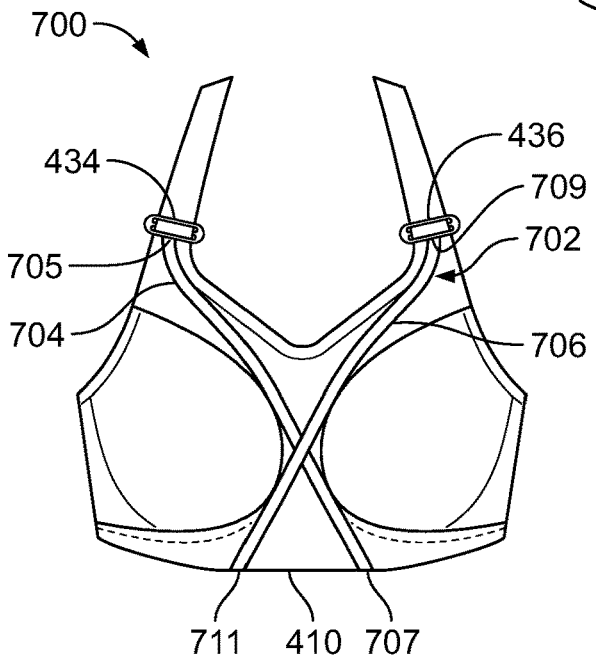

As shown in FIG. 26, the first and second tensioning elements 604 and 606 may cross each other twice and may be connected to the first and second cup layers 414 and 415. Thus, in addition to stabilizing the first and second cup layers 414 and 415 and preventing or substantially reducing the upward movement of the breasts when the user is in motion, the first and second tensioning elements 604 and 606 may pull the first cup layer 414 and second cup layer 415 closer together.

Figure 28:
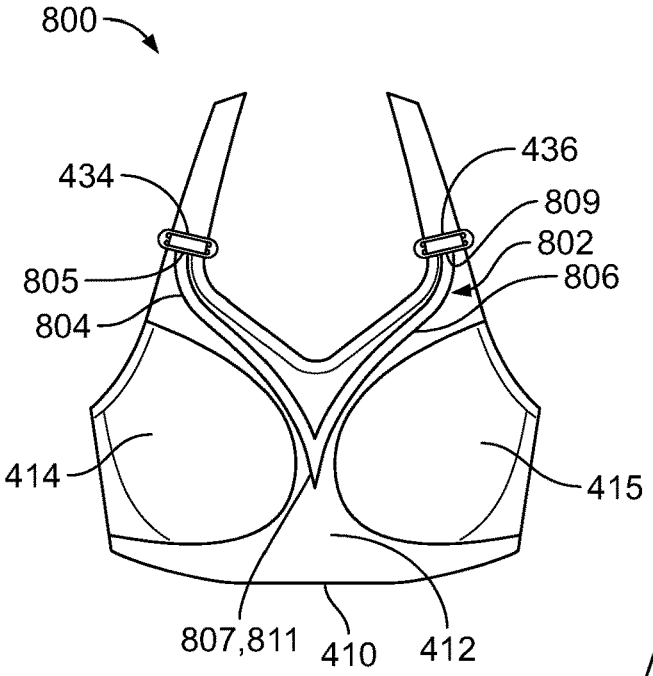

As shown in FIG. 28, the first and second tensioning elements 804 and 806 form a V-shape. The bottom of the V-shape of the first and second tensioning elements 804 and 806 is attached to the central support layer 412, which can be comprised of a material that does not stretch vertically between the cup layers 414, 415. Thus, when the first and second tensioning elements 804 and 806, the central support layer 412 transfers energy (e.g., tension) to the band 410, thus, stabilizing the first and second cup layers 414 and 415 and preventing or substantially reducing the upward movement of the breasts when the user is in motion.

Figure 29:
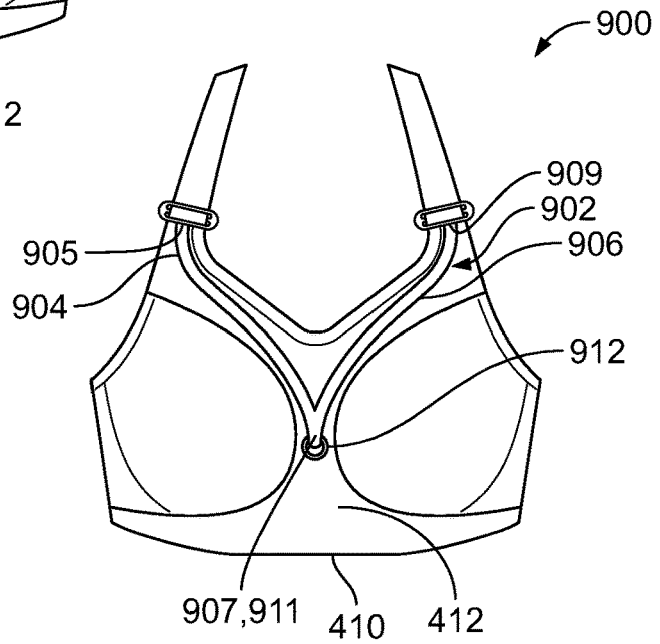

As shown in FIG. 29, the first and second tensioning elements 904 and 906 may be connected together and threaded through a round slicer 912 (e.g., ring 912), to have a V-shape, allowing the first and second tensioning elements 904 and 906 to slide about the round slicer 912 in order to equalize the tension in the first and second tensioning elements 904 and 906 for even pulling tension at the first and second shoulder straps 426, 428 and the central support layer 412. This is because the round slicer 912 is a ring that is connected to the central support layer 412 in order to transfer the tension of the first and second tensioning elements 904 and 906 to the central support layer 412, allowing for a more comfortable fit. In other words, the first and second tensioning elements 904 and 906 are connected to each other and pass through the ring 912, the ring 912 being attached to the central support layer 412 between the first and second cup layers 414 and 415, and the first and second tensioning elements 904 and 906 are free to slide about the ring 912 such that a tensile force exerted in the first tensioning element 904 is approximately equal to a tensile force exerted in the second tensioning element 906.

Figure 30:
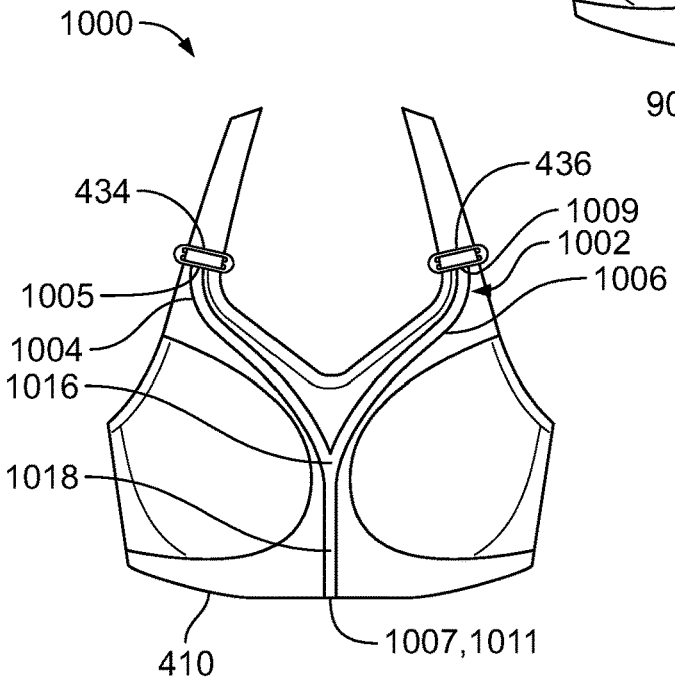

As shown in FIG. 30, the first and second tensioning elements 1004 and 1006 may be connected together at a point 1016, and may extend as a single tensioning element 1018 from the point 1016 to the band 410. Thus, the first and second tensioning elements 1004 and 1006, and the tensioning element 1018 can form a Y-shape. The first and second tensioning elements 1004 and 1006, and the tensioning element 1018 can reduce upward movement of the wearer's breasts in motion.

Figure 31:
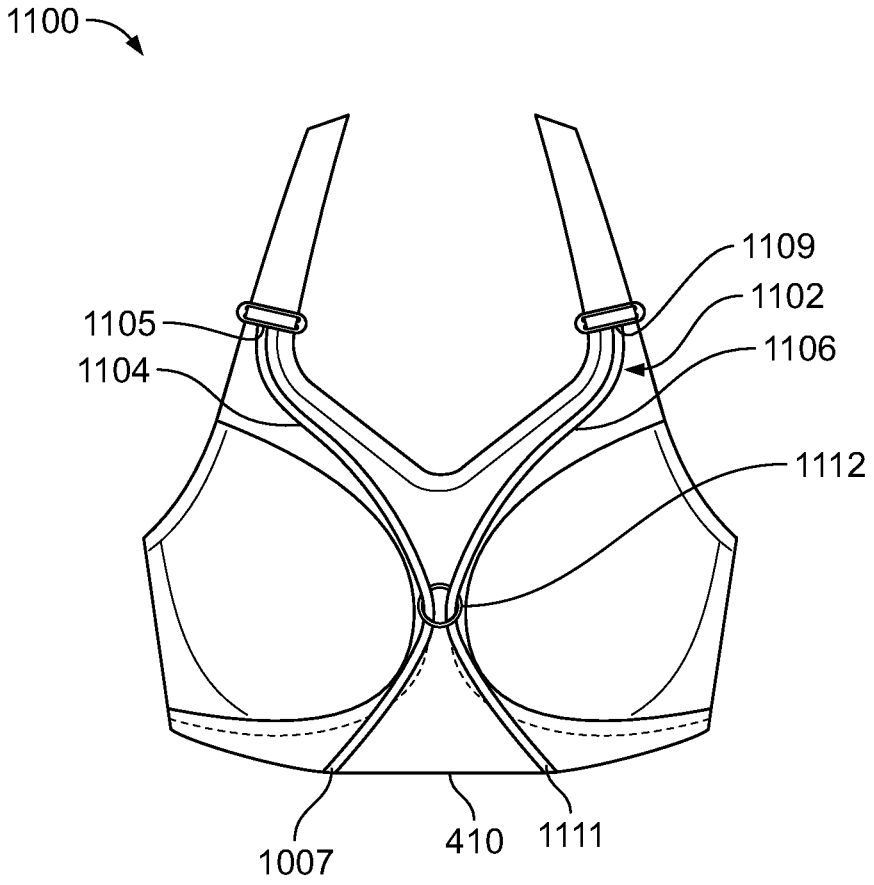

As shown in FIG. 31, the first and second tensioning elements 1104 and 1106 are threaded through a ring 1112, which allows the first and second tensioning elements 1104 and 1106 to be tightened indefinitely. Thus, the tensioning elements 1104 and 1106 can be used to tighten the front portion 402 even after the point where the cup layers 414, 415 meet each other. The ring 1112 may be disposed at a midpoint between the cup layers 414, 415.

Figure 32:
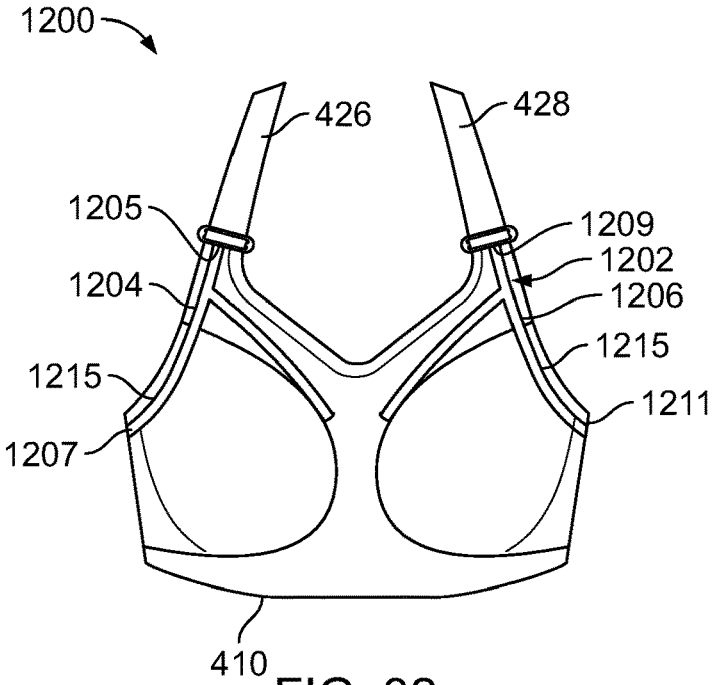
Figure 33:
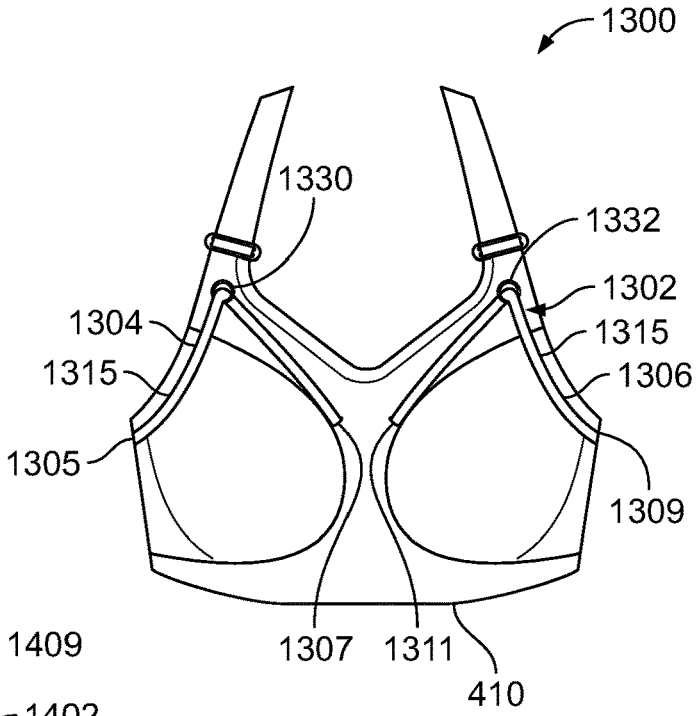
Figure 34:
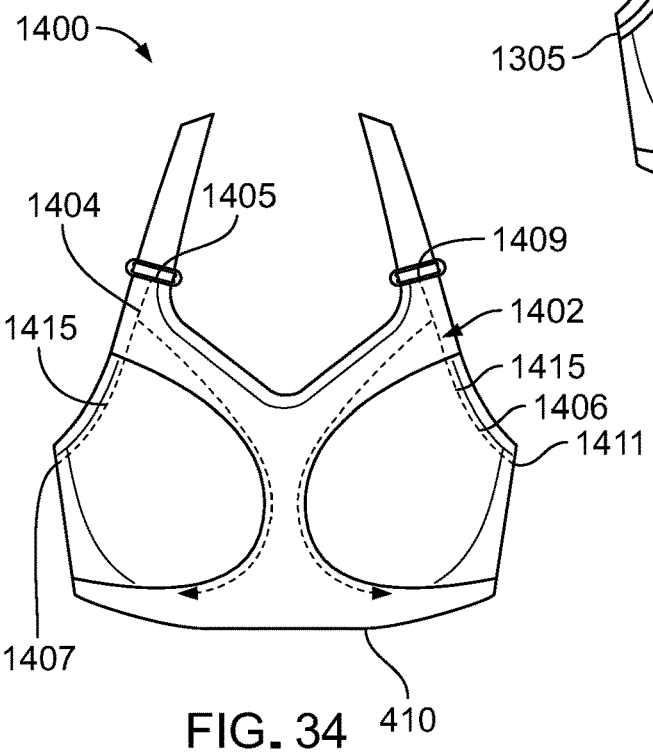

As shown in FIGS. 32-34, the support system 1200, 1300, 1400 may have an ancillary leg 1215, 1315, 1415 that starts at a point under the at a side of the bra 400 and extends along the front of an armhole toward the top end of the support system 1200, 1300, 1400. This leg 1215, 1315, 1415 may be free flowing or affixed to the bra 400.

Referring to FIG. 32, the tensioning elements 1204, 1206 are fixed at the location of the shoulder straps 426, 428. The lower portion consists of two elements: one is fixed at a point below the shoulder straps 426, 428 and creates any of the versions of the X shown in FIGS. 25-31. The secondary element 1215 (or a continuation of the original element—fixed to the shoulder strap) is positioned to the outside of the cup 414, 415, and is fixed to the side tensioning strap 468, 469. This results in the center X element being tensioned both from the bottom band as well as the side pull of the strap 468, 469.

Referring to FIG. 33, the tensioning elements 1304, 1306 are threaded through a ring 1330, 1332, which is fixed at a point below the shoulder straps 426, 428. The lower portion consists of two elements: one is directed down between the cups 414,415 and creates any of the versions of the X shown in FIGS. 25-31. The secondary element 1315 is positioned to the outside of the cup, and is fixed to the side tensioning strap 468, 469. This results in the center X element being tensioned both from the bottom band as well as the side pull of the strap 468, 469.

FIG. 34 may illustrate the same configuration of tensioning elements as that described with reference to FIG. 32, but the tensioning elements of FIG. 34 may be integrated within the front portion 402.

Thus, the front and rear portions 402 and 404, in conjunction with the support system 600, 700, 800, 900, 1000, 1100, 1200, 1300, 1400 may form highly comfortable bra 400 that provides an unparalleled level of support for the wearer's torso and breasts. The structure of the central support layer 412 (providing almost no stretch in the vertical direction and a very low amount of stretch in the horizontal direction), the low stretch and strong elasticity of the first and second cup layers 414 and 415, the three-legged configuration of the first and second back strap systems (with some elastic and some non-stretchable legs), and tension-resisting function of the support system 600, 700, 800, 900, 1000, 1100, 1200, 1300, 1400, forms a system that stabilizes the cups of the front portion in position, and provides tension across the top and bottom of the breasts to the user in motion or in a state of rest. Thus, the bra 400 may prevent or substantially reduce upward and downward motion, left to right motion, and inward out outward motion of the wearer's breasts during motion and/or a state of rest, while simultaneously providing an unsurpassed level of comfort to the wearer.

FIGS. 35-44 depict exemplary embodiments of a bra shelf 1500, 1600, 1700, 1800 that can be incorporated into the bra 400 to both provide structure and to aid in supporting for the underside of breasts by partially cupping the breasts. The bra shelf 1500, 1600, 1700, 1800 can be made of a flexible, yet rigid material that will bend and flex with the movement of the body. It is contemplated that the bra shelf 1500, 1600, 1700, 1800 can be arranged between layers of the bra 400, included as an inner layer of the bra 400 or be fixed to the outer layer of the bra 400.

As illustrated in FIGS. 35-40, the bra shelf 1500, 1600, 1700, 1800 includes a base portion 1502, 1602, 1702, 1802, which is a flat panel that, when worn, rests against an individual's torso and a cup portion 1504, 1604, 1704, 1804 that incorporates the cup shape that supports the breasts and either provides full or partial coverage to the breasts.

Figure 35:
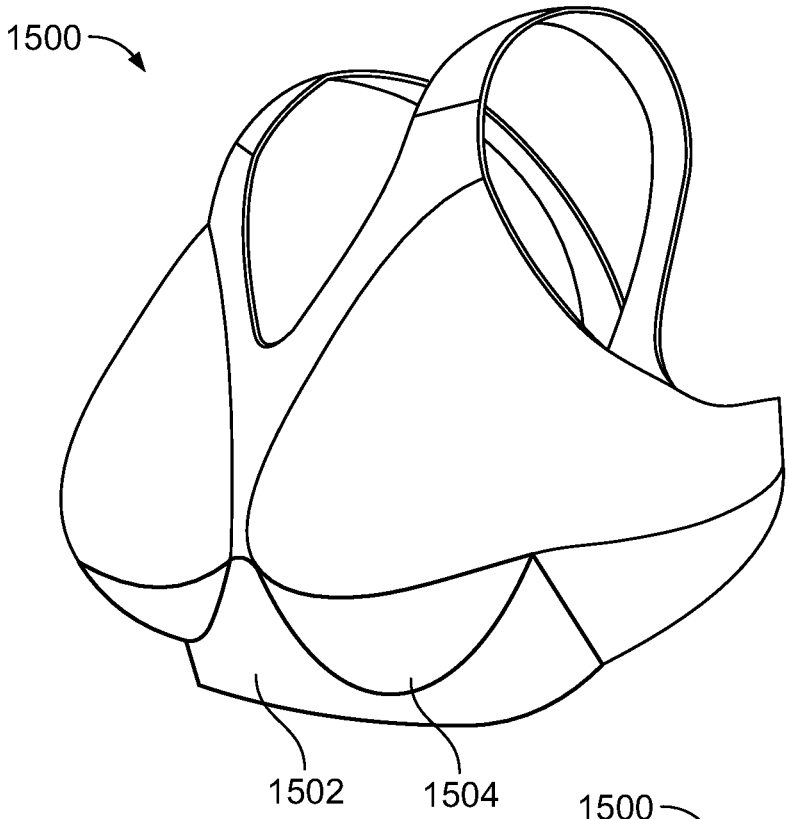
FIGS. 35-44 are various versions a shelf support of the bra of FIG. 15, which includes a base and cups of the bra of FIG. 1 according to exemplary embodiments of the present invention.
Figure 36:
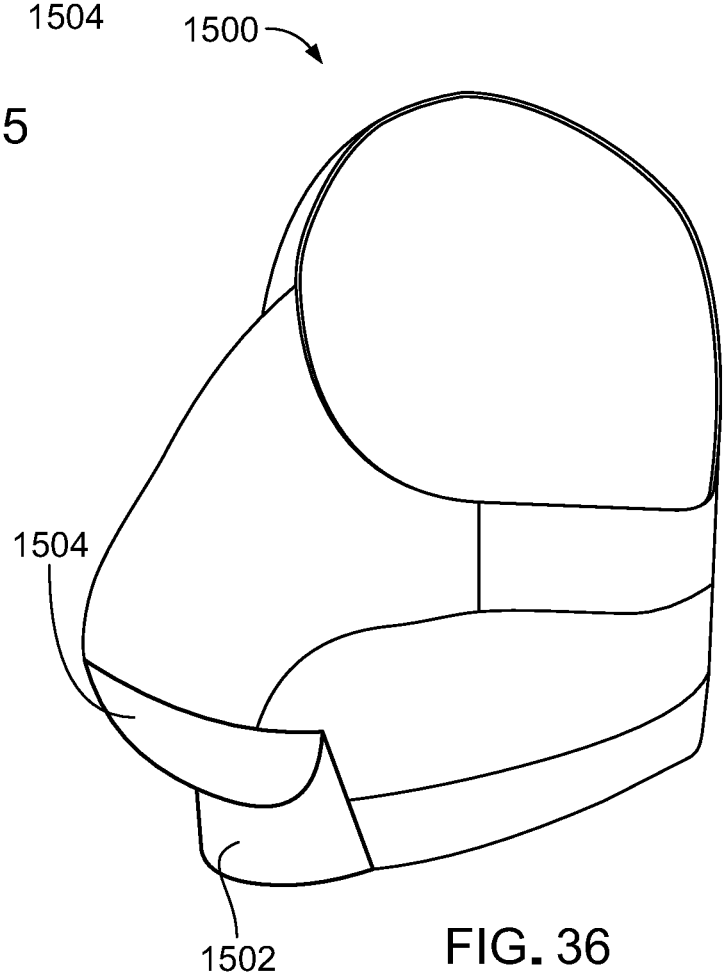
Figure 37:
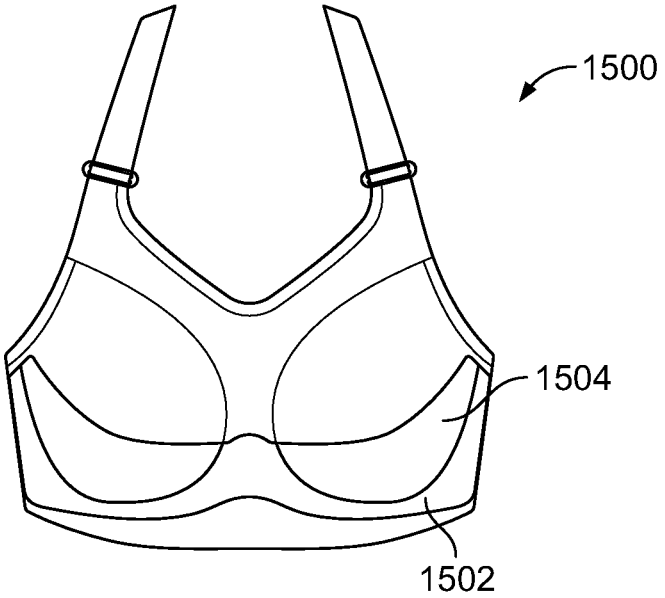
Figure 38:
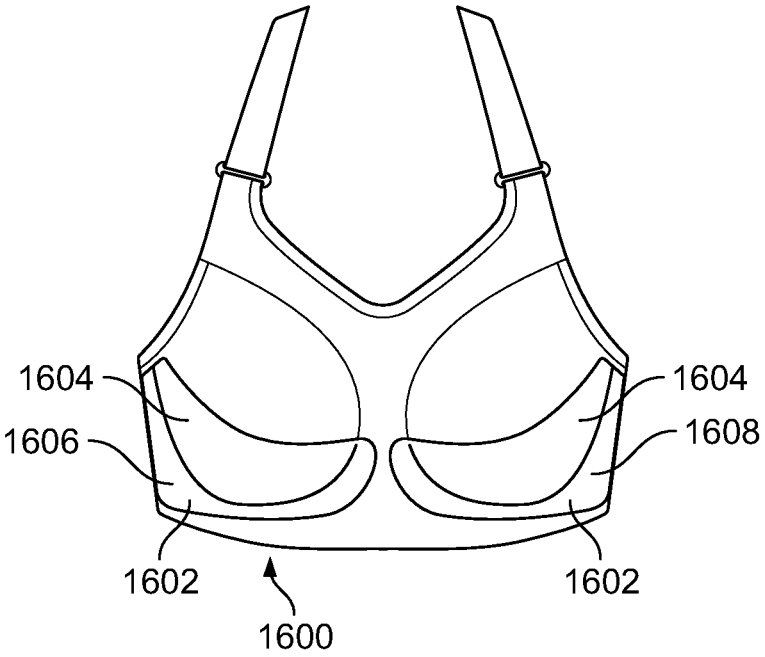

The elements of the shelf 1500, 1600, 1700, 1800 may float freely or be fixed to one or more components of the bra 400. As shown in FIG. 35-38, the bra shelf 1500, 1600 can be affixed to the bra 400. As shown in FIG. 35-37, the bra shelf 1500 can be comprised of a single body. Alternatively, as shown in FIG. 38-40, the bra shelf 1600, 1700, 1800 can be a multi-part unit that includes a first shelf 1606, 1706, 1806 and a second shelf 1608, 1708, 1808 that are separate from each other.

Figure 39:
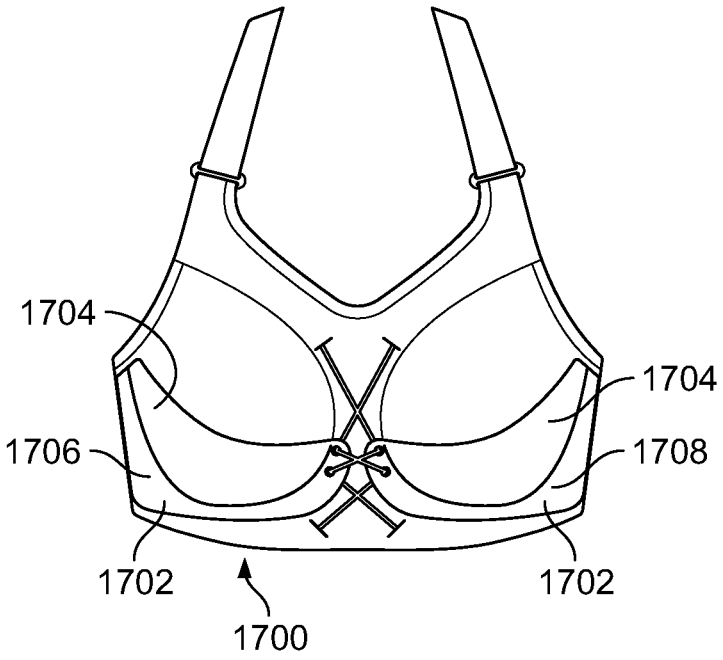

In an embodiment, as shown in FIG. 39, the bra shelf 1700, can be incorporated into a support system. Here, the right and left shelves 1706, 1708 can be connected to each other in such a way that the spacing between them can be adjusted by the support system. It is noted that although one support system is shown, any of the other support systems shown or described can be used.

Figure 40:
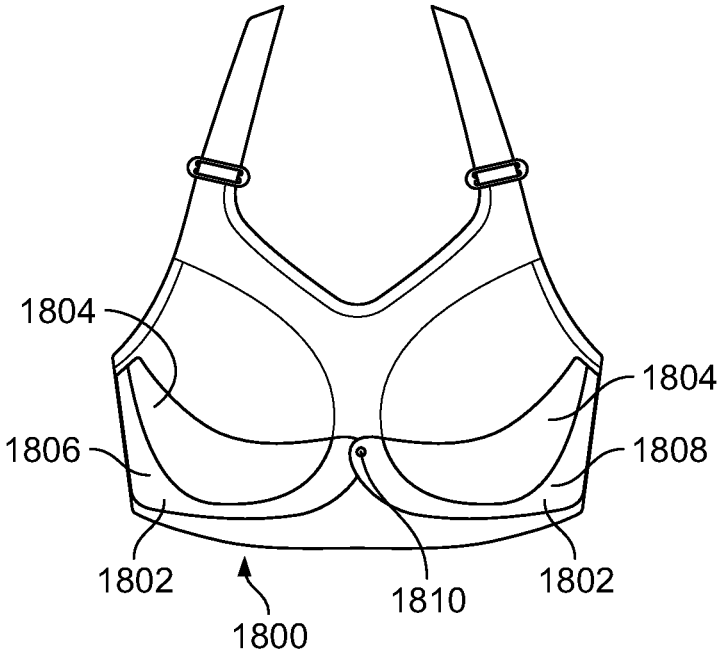
Figure 41:
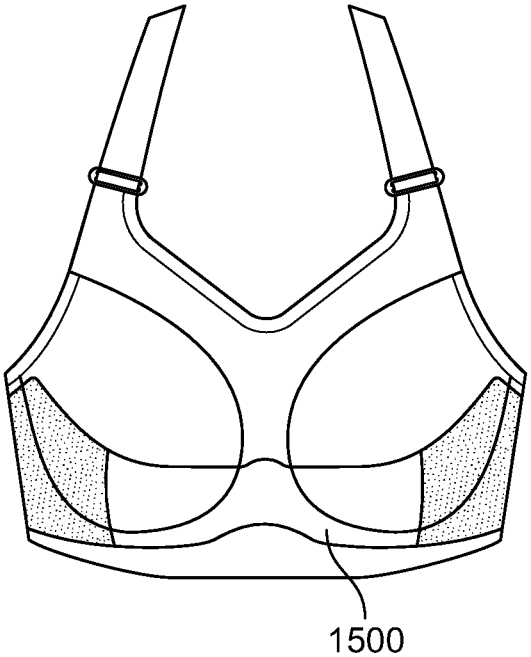
Figure 42:
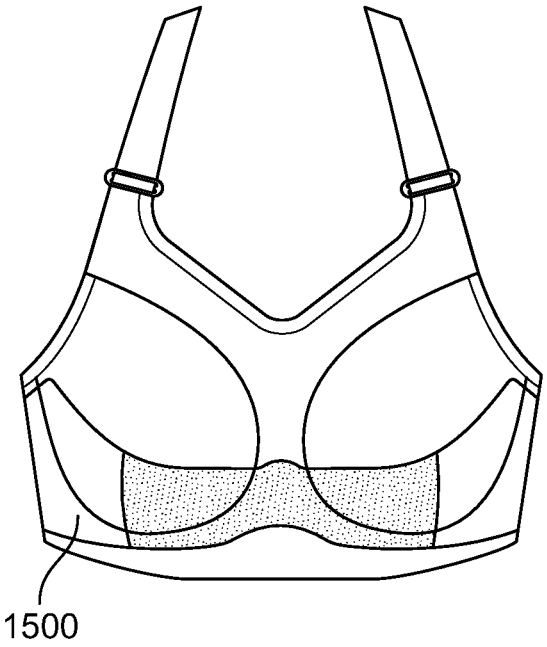
Figure 43:
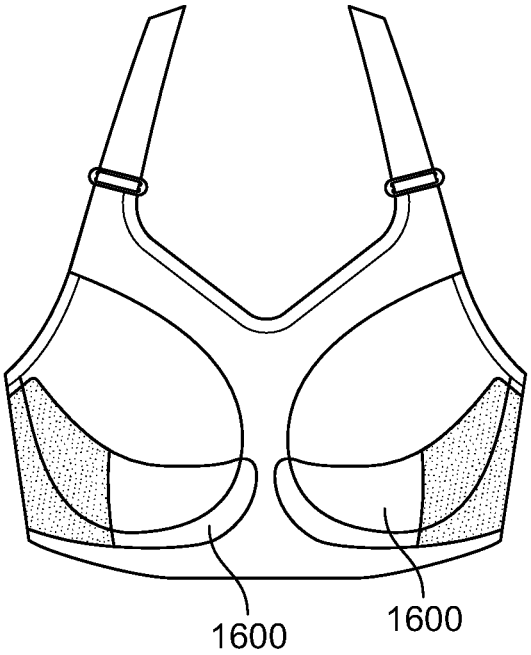
Figure 44:
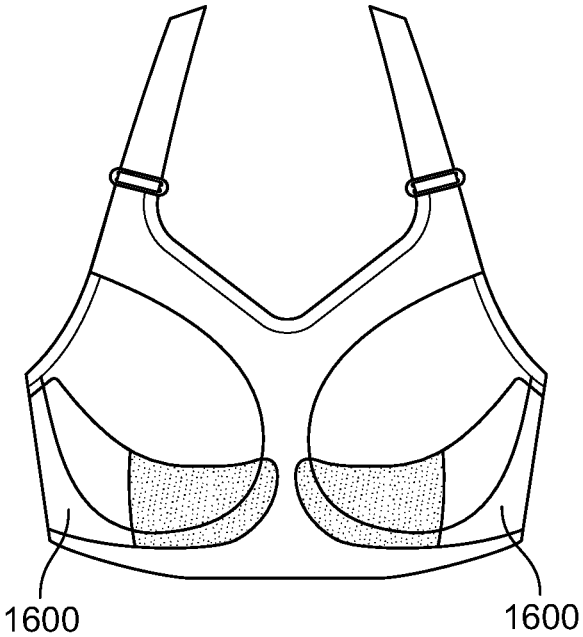

Finally, as shown in FIG. 40, the right and left shelves 1806, 1808 can be connected to each other by a fastener 1810 that allows for independent movement of the shelves 1806, 1808 in relation to each other.

FIGS. 41-44 depict embodiments of fasteners such as an adhesive applied to the shelf 1500, 1600 to secure the shelf 1500, 1600 to the bra 400.

The foregoing description and associated images illustrate several embodiments of the invention and its respective constituent parts. However, other types of materials and patterns combining materials are possible. As such, the images are not intended to be limiting in that regard. Thus, although the description above and accompanying images contain much specificity, the details provided should not be construed as limiting the scope of the embodiments, but merely as providing illustrations of some of embodiments of the present disclosure. The images and the description are not to be taken as restrictive on the scope of the embodiments and are understood as broad and general teachings in accordance with the present invention. While the present embodiments of the invention have been described using specific terms, such description is for present illustrative purposes only, and it is to be understood that modifications and variations to such embodiments, including but not limited to the substitutions of equivalent features, materials, or parts, and the reversal of various features thereof, may be practiced by those of ordinary skill in the art without departing from the spirit and scope of the invention.

What is claimed is:

1. A bra, comprising:

a body including a front portion, a rear portion, a first side portion extending between a first end of the front portion and a first end of the rear portion, a second side portion extending between a second end of the front portion and a second end of the rear portion, a first shoulder strap fixed to and extending between the front portion and the rear portion and a second shoulder strap fixed to and extending between the front portion and the rear portion, the back portion includes a first back strap system that includes at least a first panel and a second back strap system that includes at least a second panel, the first panel and the second panel being independent of each other such that one of the first panel and the second panel is extendable and slideable over the other of the first panel and the second panel, a side strap that is connected directly to and configured to adjust tension of the first back strap system and affixable to the front portion, another side strap that is connected directly to and configured to adjust tension of the second back strap system and affixable to the front portion and a front support system affixable to the front portion and that includes a first piece of material and a second piece of material and that is configured to adjust tension across the front portion of the bra in conjunction with the side strap and the another side strap.

2. The bra of claim 1, wherein the first shoulder strap is comprised of one or more pieces of material that are connected to each other with one piece of material including elastomeric properties and the other piece of material including non-elastomeric properties and the second shoulder strap is comprised of one or more pieces material that are connected to each other with one pieces of material including elastomeric properties and the other piece of material including non-elastomeric properties.

3. The bra of claim 1, wherein the first back strap system includes a first leg, a second leg that extends at a first angle in a first direction from the first leg toward the second side portion and a third leg extending at a second angle from the first leg in a second direction toward the first side portion and a first panel extending contiguously from the third leg and the second back strap system, which is independent of the first back strap system and a mirror opposite configuration of the first back strap system includes a first leg, a second leg that extends at a first angle in a first direction from the first leg toward the first side portion and a third leg that extends at a second angle from the first leg in a second direction toward the second side portion and a second panel extending contiguously from the third leg.

4. The bra of claim 3, further comprising a band that extends about a periphery of the bra at the bottom end of the front portion, the rear portion and the first side portion and second side portion with the first panel extending from the back portion around the first side portion toward the front portion and being fixed along a bottom edge thereof directly to the band.

5. The bra of claim 3, further comprising a band that extends about a periphery of the bra at the bottom end of the front portion, the rear portion and the first side portion and second side portion with the second panel extending from the back portion around the second side portion toward the front portion and being fixed along a bottom edge thereof directly to the band.

6. The bra of claim 1, further comprising a band that extends about a periphery of the bra at the bottom end of the front portion, the rear portion and the first side portion and second side portion.

7. The bra of claim 6, wherein the band is comprised of an elastomeric material to allow for adaptability and to aid in compression of the bra.

8. The bra of claim 6, wherein the band includes a fastening system to fix to a first end and a second end thereof to each other.

9. The bra of claim 1, wherein the front portion comprises at least one layer of material including an external support layer and a cup layer.

10. The bra of claim 1, wherein the support layer includes at least one panel whereby at least a portion of the panel includes elastomeric properties.

11. The bra of claim 9, wherein the cup layer includes at least one of a first cup and a second cup, which is independent of the first cup and a single unit wherein a first cup is connected to the second cup.

12. The bra of claim 1, wherein the first piece of material and the second piece of material are each comprised of a single piece of elastomeric material.

13. The bra of claim 1, wherein the first piece of material and the second piece of material are each comprised of a blend of non-elastomeric and elastomeric material.

14. The bra of claim 1, wherein the first piece of material and the second piece of material are at least one of independent elements of each other such that one of the first piece of material and the second piece of material slides over or under the other of the first piece of material and the second piece of material and fixed to each other.

15. The bra of claim 1, wherein at least one of a first end of the first piece of material is fixed to the first shoulder strap and a first end of the second piece of material is fixed to the second shoulder strap and the first end of the first piece of material is fixed adjacent to the first shoulder strap and the first end of the second piece of material is fixed adjacent to the second shoulder strap.

16. A method of securing an athletic bra, the method comprising the steps of:

providing the bra that includes a body including a front portion, a rear portion, a first side portion extending between a first end of the front portion and a first end of the rear portion, a second side portion extending between a second end of the front portion and a second end of the rear portion, a first shoulder strap fixed to and extending between the front portion and the rear portion and a second shoulder strap fixed to and extending between the front portion and the rear portion, the back portion includes a first back strap system that includes at least a first panel and a second back strap system that includes at least a second panel, the first panel and the second panel being independent of each other such that one of the first panel and the second panel is extendable and slideable over the other of the first panel and the second panel, a side strap that is connected directly to and configured to adjust tension of the first back strap system, another side strap that is connected directly to and configured to adjust tension of the second back strap system and a front support system affixable to the front portion and that includes a first piece of material and a second piece of material and that is configured to adjust tension across the front portion of the bra in conjunction with the side strap and the another side strap;

placing the bra on an individual;

grasping and pulling the side strap such that the second shoulder strap is tensioned, the second piece of material that is part of the front support system compresses a respective first half of the front portion toward the user and the first back strap system is tensioned toward the first side portion;

connecting the side strap to the band at the front portion;

grasping and pulling the other side strap such that the first shoulder strap is tensioned, the first piece of material that is part of the front support system compresses a respective second half of the front portion toward the individual and the second back strap system is tensioned toward the second side portion; and connecting the other side strap to the band at the front portion.

* * * * *